US012071731B2

(12) United States Patent
Hagenauer et al.

(10) Patent No.: US 12,071,731 B2
(45) Date of Patent: Aug. 27, 2024

(54) FIBRE MOULDING PLANT FOR PRODUCING MOULDED PARTS FROM ENVIRONMENTALLY DEGRADABLE FIBRE MATERIAL

(71) Applicant: Kiefel GmbH, Freilassing (DE)

(72) Inventors: Richard Hagenauer, Saaldorf-Surheim (DE); Matthias Hausmann, Unken (AT)

(73) Assignee: Kiefel GmbH, Freilassing (DE)

( * ) Notice: Subject to any disclaimer, the term of this patent is extended or adjusted under 35 U.S.C. 154(b) by 212 days.

(21) Appl. No.: 17/754,791

(22) PCT Filed: Oct. 1, 2020

(86) PCT No.: PCT/DE2020/000230
§ 371 (c)(1),
(2) Date: Apr. 12, 2022

(87) PCT Pub. No.: WO2021/073674
PCT Pub. Date: Apr. 22, 2021

(65) Prior Publication Data

US 2023/0243107 A1 Aug. 3, 2023

(30) Foreign Application Priority Data

Oct. 14, 2019 (DE) ..... 102019127562.8

(51) Int. Cl.
*D21J 5/00* (2006.01)
*D21J 1/04* (2006.01)

(52) U.S. Cl.
CPC .. *D21J 5/00* (2013.01); *D21J 1/04* (2013.01)

(58) Field of Classification Search
CPC ..... D21J 5/00; D21J 1/04; D21J 3/00
See application file for complete search history.

(56) References Cited

U.S. PATENT DOCUMENTS 7,909,964 B2 * 3/2011 Nilsson ..... D21J 7/00 162/376
8,246,784 B2 * 8/2012 Nilsson ..... D21J 3/00 162/226

(Continued)

FOREIGN PATENT DOCUMENTS

CN 105369695 B * 11/2017 ..... D21J 5/00
DE 102021114662 A1 * 12/2022 ..... B29B 11/12

(Continued)

OTHER PUBLICATIONS

International Search Report and Written Opinion in PCT Appl. No. PCT/DE2020/000230 mailed Apr. 23, 2021, 15 pages.

*Primary Examiner* — Jose A Fortuna
(74) *Attorney, Agent, or Firm* — Kowert, Hood, Munyon, Rankin & Goetzel, P.C.; Gareth M. Sampson; Dean M. Munyon

(57) ABSTRACT

The present disclosure relates to a molding station (20) for molding (210), a preforming station (30) for preforming (220), a hot-pressing station (40) for final shaping (230) a formed part (10) made of environmentally-friendly-degradable fiber material (11) in a fiber-forming process in a fiber-forming system (100). The fiber-forming system (100) produces the formed part (10) having the above components (20, 30, 40) by means of the method (200) performed in the fiber-forming system (100) as a fiber-forming process.

20 Claims, 7 Drawing Sheets

(56) References Cited

U.S. PATENT DOCUMENTS

| | | | | |
|---|---|---|---|---|
| 10,711,404 | B2 * | 7/2020 | Sundblad | D21J 3/00 |
| 11,291,253 | B2 * | 4/2022 | Kuo | D21J 3/00 |
| 2003/0051845 | A1 | 3/2003 | Gale et al. | |
| 2003/0111201 | A1 * | 6/2003 | Sato | D21J 5/00 162/405 |
| 2011/0168346 | A1 * | 7/2011 | Nilsson | D21J 7/00 162/382 |
| 2017/0370049 | A1 * | 12/2017 | Andersson | B22F 3/1109 |
| 2022/0388201 | A1 * | 12/2022 | Knoll | D21J 7/00 |
| 2023/0243107 | A1 * | 8/2023 | Hagenauer | D21J 3/00 162/224 |
| 2023/0311375 | A1 * | 10/2023 | Neuhofer | B29C 43/003 264/40.1 |
| 2023/0313458 | A1 * | 10/2023 | Neuhofer | D21F 13/10 162/226 |

FOREIGN PATENT DOCUMENTS

| | | | | | |
|---|---|---|---|---|---|
| DE | 102022111908 | A1 * | 11/2023 | | D21J 3/00 |
| EP | 1197596 | A1 | 4/2002 | | |
| EP | 1235462 | A4 * | 12/2007 | | D21J 7/00 |
| EP | 4101981 | A1 * | 12/2022 | | B29B 11/12 |
| TW | I816115 | B * | 5/2021 | | D21H 11/16 |
| WO | 9317183 | A1 | 9/1993 | | |
| WO | 03035981 | A1 | 5/2003 | | |
| WO | WO-2006057610 | A3 * | 11/2006 | | D21J 1/06 |
| WO | WO-2021073671 | A1 * | 4/2021 | | D21J 3/00 |
| WO | WO-2021073672 | A1 * | 4/2021 | | D21J 3/00 |
| WO | WO-2021073673 | A2 * | 4/2021 | | D21J 3/00 |
| WO | WO-2021073674 | A3 * | 6/2021 | | D21J 1/04 |
| WO | WO-2023217540 | A1 * | 11/2023 | | D21J 3/00 |

* cited by examiner

FIBRE MOULDING PLANT FOR PRODUCING MOULDED PARTS FROM ENVIRONMENTALLY DEGRADABLE FIBRE MATERIAL

TECHNICAL FIELD

Embodiments described herein relate to a molding station for molding, a preforming station for preforming, a hot-pressing station for final shaping a formed part made from environmentally-friendly-degradable fiber material in a fiber-forming process in a fiber-forming system and a fiber-forming system for producing the formed part with the above components by means of a method performed in the fiber-forming system as the fiber-forming process.

BACKGROUND

It is desirable to protect citizens and the environment from plastic pollution. In particular, single-use plastic products such as packaging materials or plastic cutlery and tableware generate a large amount of waste. In this respect, there is an increasing need for substitutes for packaging materials and containers made of plastic, with which substitutes these products can be made from recyclable plastics, materials with less plastic content or even from plastic-free materials.

The idea of using natural fibers instead of classic plastics in the extrusion process has existed at least since the early 1990s, see, for example, EP 0 447 792 B1. As in most fiber-processing processes, the raw material basis here is pulp. In principle, pulp consists of water, natural fibers and a binder such as industrial starch (potato starch) and has a pulpy consistency.

Since consumers are interested in a wide variety of environmentally-friendly products with different sizes, shapes and requirements and do not necessarily want them in very large quantities, it would be desirable to have a manufacturing process for environmentally-friendly formed parts made of natural fibers and a corresponding machine available to produce these products (formed parts) effectively, flexibly and with good quality in a reproducible manner.

SUMMARY

An object of the present disclosure is to provide a manufacturing method for environmentally-friendly formed parts made of natural fibers and a corresponding machine with which these products (formed parts) can be produced effectively, flexibly and with good quality in a reproducible manner.

According to a first aspect of the present disclosure, an object is achieved by a molding station for a fiber-forming system for molding a formed part made from environmentally-friendly-degradable fiber material in a fiber-forming process, comprising

- a suction tool for sucking the environmentally-friendly degradable fiber material for molding the formed part from a reservoir with a pulp as a liquid solution with the environmentally-friendly degradable fiber material, wherein the suction tool comprises a suction head with a three-dimensionally shaped suction head suction side, which with its shape is adapted to a contour of the subsequent formed part, and the formed part is molded on the suction head suction side by means of a vacuum (suction pressure) in the suction tool; and

- a movement unit on which the suction tool is mounted, which is provided at least for placing or for partially immersing the suction tool on or in the pulp.

The term "environmentally-friendly-degradable fiber material" refers to fiber materials that can be decomposed by environmental factors such as moisture, temperature and/or light, with the decomposition process taking place in the short term, for example, in the range of days, weeks or a few months. For the sake of simplicity, the "environmentally-friendly-degradable fiber material" is below sometimes simply referred as "fiber material". Preferably, neither the fiber material nor the decomposition products should pose an environmental hazard or contamination. Fiber materials, which in the context of the present disclosure represent an environmentally-friendly-degradable fiber material, are, for example, natural fibers obtained from cellulose, paper, cardboard, wood, grass, plant fibers, sugar cane residues, hemp, etc. or from their components or parts thereof and/or correspondingly recycled material. However, environmentally-friendly-degradable fiber material can also refer to artificially produced fibers such as PLA (polylactide), etc., which correspond to the above fiber materials or have their properties. The environmentally-friendly-degradable fiber material is preferably compostable. The environmentally-friendly-degradable fiber material and the containers made from it are preferably suitable for introduction into the material cycle of the German organic compost bin and as a resource for biogas plants. The fiber materials and the containers made from them are preferably biodegradable in accordance with EU standard EN 13432.

The term "pulp" refers to fluid masses that contain fibers, here the environmentally-friendly-degradable fiber material. The term "liquid" refers here to the state of aggregation of the pulp, the liquid pulp comprising the environmentally-friendly-degradable fiber material in the form of fibers (liquid solution with the environmentally-friendly-degradable fiber material). The fibers can be present as individual fibers, as a fiber structure or as a fiber group composed of a number of connected fibers. The fibers represent the fiber material, regardless of whether they are in the pulp as individual fibers, as a fiber structure or as a group of fibers. The fibers are dissolved in the liquid solution in such a way that they float in the liquid solution as much as possible with the same concentration, regardless of location, for example, as a mixture or suspension of liquid solution and fiber material. For this purpose, for example, the pulp can be appropriately tempered and/or circulated in some embodiments. The pulp preferably has a low consistency, i.e., a proportion of fiber material of less than 8%. In one embodiment, a pulp with a proportion of environmentally-friendly, degradable fiber material of less than 5%, preferably less than 2%, particularly preferably between 0.5% and 1.0%, is used in the method described herein. This small proportion of fiber material can, among other things, prevent clumping of the fiber material in the liquid solution, so that the fiber material can still be molded onto the suction tool with good quality. Clumped fiber material can be sucked in by the suction tool, but would probably result in a formed part with a fluctuating layer thickness, which should be avoided in the production of the formed parts, if possible. In this respect, the proportion of fiber material in the pulp should be small enough so that clumping or chaining does not occur or occurs only to a negligible extent. The liquid solution can be any solution suitable for the fiber-forming process. For example, the pulp can be an aqueous solution containing the environmentally-friendly, degradable fiber material. An aqueous solution is, among other things, an easy-to-handle solution.

The fiber-forming process refers to the process steps that are involved in forming the formed part, beginning with providing the pulp, molding the formed part from the fiber material from the pulp in the molding station, preforming the formed part in the preforming station, hot-pressing the formed part in the hot-pressing station and optionally coating the formed part with functional coatings, wherein the coating can be arranged at any point in the fiber-forming process that is suitable for the respective coating to be applied.

The formed parts can have any shape, also referred to here as a contour, provided this shape (or contour) can be produced in the method described herein or the method is suitable for producing this shape (or contour). The components used for the fiber-forming process can be adapted to the respective shape (or contour) of the formed part. In the case of different formed parts with different shapes (or contours), different correspondingly adapted components such as the suction tool, the suction head, the prepressing station, the hot-pressing station, etc. can be used. The target contour of the formed part and thus the corresponding shaping components is preferably designed in such a way that all surfaces of the formed part have an angle $\alpha$ of at least 3 degrees to the pressing direction during hot-pressing. For example, a surface perpendicular to the pressing direction (maximum pressure) has an angle $\alpha=90$ degrees. This ensures that the hot-pressing pressure can be applied to all surfaces of the formed part. No pressure can be applied to surfaces parallel to the direction of pressure during hot-pressing. Final-shaped formed parts can represent a wide variety of products, for example, cups, containers, vessels, lids, bowls, portion containers, casings or containers for a wide variety of purposes.

The suction tool refers here to the tool in which the suction head or heads are arranged for molding the formed part. With a single suction head, this is also the suction tool. If there are several suction heads that are operated simultaneously, they are all arranged in the common suction tool, so that when the suction tool is moved, the individual suction heads in the suction tool are also moved. The supply of media to the suction tool with a plurality of suction heads is routed in a suitable manner to the individual suction heads in the suction tool.

Placing the suction tool on the pulp means that all of the suction heads provided in the suction tool for the molding of formed parts at least come into contact with the pulp, in such a way that, due to the vacuum or suction pressure applied to the pulp with the suction tool, the fiber material is pulled out of the pulp or the pulp with fiber material dissolved therein is sucked in. During the partial immersion into the pulp, the suction tool is not only placed on the pulp, but immersed into it. The immersion depth of the suction tool in the pulp depends on the respective application and the respective fiber-forming process and can differ depending on the application and possibly the formed part to be formed.

The suction head can have a negative form. A negative form is a form where the suction side of the suction head, i.e., the side where the fiber material is deposited due to the suction effect of the suction head and thus molds the formed part, is on the inside of the suction head, so that this inside, after the suction head has been placed on the pulp or the suction head has been immersed in the pulp, forms a cavity into which the pulp with the fiber material is sucked (as shown in FIG. 1). In the case of a negative form, the outside of the subsequent formed part faces the inside of the suction head. After molding, the formed part therefore sits on the inside of the suction head.

The suction head can also have a positive form. A positive form is a form where the suction side of the suction head, i.e., the side where the fiber material is deposited due to the suction effect of the suction head and thus forms the formed part, is on the outside of the suction head, so that this outside after the suction head has been placed on the pulp or the suction head has been immersed in the pulp, does not form a cavity (as shown in FIG. 1). In the case of a positive form, the inside of the subsequent formed part faces the outside of the suction head. After molding, the formed part therefore sits on the outside of the suction head.

The molding of the formed part refers to a first preforming of the formed part, whereby this formed part is formed from fiber material formerly randomly distributed in the pulp by means of accumulation of the fiber material on the contour of the suction head with the corresponding contour. The molded formed part still has a large proportion, for example, 70%-80%, of liquid solution, for example, water, and is therefore not yet dimensionally stable.

By means of the molding station, a formed part is easily molded from a pulp with a fiber material, which can very flexibly deliver formed parts with a wide variety of contours, depending on the configuration of the contour of the suction head. The ratio of width or diameter to height of the formed part does not represent a limiting or critical parameter for the quality of the production of the respective formed part. The molding station described herein makes it possible to produce the formed parts in a very reproducible manner and with great accuracy and quality with regard to the shape and layer thickness of the individual formed part sections. The molding station is able to process fibers of all kinds, as long as they can be dissolved in such a way that extensive clumping of the fibers in the liquid solution can be avoided before processing. In particular, this way, stable formed parts can be produced easily, effectively and flexibly from environmentally-friendly-degradable fiber material with good quality and good reproducibility.

The molding station described herein thus enables, together with subsequent forming steps described herein, the production of environmentally-friendly formed parts from natural fibers in an effective, flexible and reproducible manner with good quality.

In a further embodiment, the suction head suction side of the suction head is formed by a porous screen on a suction side surface of the suction head, wherein, on the pulp side of the screen facing the pulp, the environmentally-friendly-degradable fiber adheres due to the suction. The screen must have a porosity such that the pulp together with the fiber material can be sucked through the screen and the liquid solution of the pulp can pass through the screen. However, the porosity of the screen must not be too large so that the fiber material can adhere to the pulp side.

In a further embodiment, the screen has a wavy structure with wave crests and wave troughs along the suction-side surface, wherein the screen rests at least during suction with the wave crests of its side facing the suction-side surface on the suction-side surface. As a result, the screen is mechanically supported in a simple manner during molding so that its shape does not change and therefore a reproducible shape of the formed part is ensured and on the other hand it can be made porous enough to ensure good suction behavior of the pulp.

In a further embodiment, the suction tool comprises a plurality of suction channels which terminate on the suction-side surface below the screen and are distributed over the suction-side surface in such a way that essentially the same suction power is enabled in all areas between the screen and the suction-side surface. Due to the plurality of suction channels, it is possible, among other things, to suck in pulp with fiber material over the entire surface of the screen, so that the formed part can mold itself on the surface of the screen. The term "substantially" refers here to a homogeneity of the suction power that is sufficient to achieve a uniformly molded formed part without significant layer thickness variations at the corners and edges of the formed part and over the surfaces of the formed part. As a result, the resulting molded formed part has a layer thickness variation of less than 7% from the desired layer thickness. In a further embodiment, the suction channels have openings in the suction-side surface with diameters of less than 4 mm.

In a further embodiment, the suction channels have an uneven distribution on the suction-side surface, with 40%-60% fewer suction channels in the area of negative edges in the formed part and/or 10%-30% more suction channels per unit area in the area of positive edges are arranged than on plane surfaces. As a result of this lower or higher density of suction channels in the area of edges (here refers to all corners and edges, indentations and more significant contour changes in the formed part, negative or positive edges refer to the contour as inner or outer edges), excess or shortage of material in the area of the edges relative to other material thicknesses on surfaces without edges are avoided.

In a further embodiment, the screen is fastened in the suction head only with reversible fastening means, preferably clamping means. As a result, the screens can be quickly and easily removed from the suction tool for cleaning processes or exchanged if necessary. This exchange is also favored, among other things, by the fact that the screen is already supported by it resting on the suction-side surface, which avoids additional brackets. In a further embodiment, the screen is fastened in at least some of the suction channels, if necessary.

In a further embodiment, the suction head comprises, on its end face facing the pulp, a collecting ring for receiving the liquid solution of the pulp sucked through the suction side of the suction head, which collecting ring is connected to a discharge channel for the liquid solution. Among other things, the liquid solution that has passed through the screen can be safely removed from the suction head and thus from the suction tool, so that this liquid solution does not negatively influence the suction power of the suction head.

In a further embodiment, the suction head suction side of the suction head is represented either as a negative form, the suction head inside, or as a positive form, the suction head outside. With regard to the terms "negative form" and "positive form", reference is made to the explanations above. Depending on the desired shape or contour of the formed part and the further processing, negative forms or positive forms of the suction head can be advantageous.

In a further embodiment, the suction tool is a multi-tool with a plurality of suction heads. With a multi-tool, a plurality of formed parts can be formed simultaneously from a common pulp bath according to the number of suction heads, which increases the throughput of the fiber-forming system and thus allows the fiber-forming system to produce more economically.

In a further embodiment, the shapes of the suction heads in the suction tool can differ at least in part, preferably the same shapes of the suction heads are arranged adjacently in the suction tool. The different shapes can, for example, be arranged in modules in the suction tool. Such a suction tool is able to produce different formed parts simultaneously in the same fiber-forming process. For example, vessels such as cups and the associated lids can be simultaneously formed and further processed in the same suction tool.

In a further embodiment, the suction tool comprises a base plate with suction heads mounted thereon and a gas line system in the base plate, which distributes at least the vacuum provided by a vacuum pump to the suction heads for sucking in the fiber material. The base plate can be connected to the movement unit in a simple and standardized way, while the suction heads mounted on it can differ depending on the desired formed part. The base plate enables the suction heads to be exchanged quickly, if necessary. The vacuum pump can be positioned at a location remote from the suction tool and can distribute the vacuum generated to the suction heads via the gas line system.

In a further embodiment, the gas line system also includes compressed gas lines for applying compressed air to the suction heads. The formed parts can be ejected from the suction tool by a blast of compressed air, for example, after they have been transferred to a hot-pressing lower tool.

In a further embodiment, the gas line system for the vacuum comprises main gas lines and secondary gas lines, wherein the main gas lines are provided for generating a pre-vacuum and the secondary gas lines are provided as a supplement to the main gas lines for achieving the suction vacuum after the suction tool has come into contact with the pulp. In this way, a large volume of gas can be pumped out quickly in order to have a vacuum applied on the suction heads. The process vacuum required for the molding of the formed part can then be quickly adjusted via the suction power on the secondary gas lines, which represent additional pump-out lines to the main lines.

In a further embodiment, one or more valves are suitably arranged in the gas line system to switch off at least one suction pressure at the suction heads as soon as the suction tool has left the pulp and/or to switch on at least the secondary gas lines in addition to the main lines as soon as the suction tool is immersed in the pulp. As a result, the molding process can be made faster and more economical, among other things.

In a further embodiment, the movement unit comprises a robotic arm that can move freely in space and on which the suction tool is mounted. As a result, the molding station can easily and flexibly supply one or more preforming stations and/or one or more hot-pressing stations with molded or preformed formed parts. Thus, the manufacturing process can be accelerated or modified depending on the required production rate, among other things. In a further embodiment, the movement unit is therefore intended to transfer the formed parts in the suction tool to the prepressing station of a preforming station and/or to the hot-pressing station.

In a further embodiment, the robotic arm is connected to the suction tool with a suitable interface that comprises all media supply connections for the suction tool. This means that standardized suction tools can be used, which enable a quick exchange, if necessary.

In a further embodiment, the movement unit is provided for completely immersing the suction head or suction heads into the pulp for contact. Complete immersion is particularly suitable for a suction head as a positive form, since here, in contrast to a negative form; there is no internal cavity in the suction head in which suction pressure (vacuum) can be generated between the pulp and the suction side to suck in the fiber material. In order to ensure that the fiber material is sucked up as evenly as possible, it is advantageous, with a positive form, to completely immerse the suction head in the pulp.

In a further embodiment, the movement unit and the suction tool are configured to leave the molded formed parts in the prepressing station for prepressing in the suction tool after the transfer to the preforming station.

Since the formed part is still relatively moist when it is molded in the suction head and therefore not very dimensionally stable, it is advantageous for a fault-free and qualitatively good process to leave the formed part in the suction head at least until the completion of the prepressing to avoid tool changes for the formed part that could damage its shape. Since the suction tool is the prepressing upper tool in the preforming station, this also speeds up the preforming process.

In a further embodiment, the movement unit and the suction tool are configured to eject the molded formed parts in the hot-pressing station from the suction tool for the subsequent hot-pressing. This can be done, for example, by means of a pressure surge on the preformed formed parts in the suction tool, so that the formed parts can be quickly transferred to the hot-pressing station. In a further embodiment, the movement unit and the suction tool are therefore configured to eject the formed parts from the suction heads of the suction tool using compressed air.

According to a second aspect of the present disclosure, the object is achieved by a preforming station for a fiber-forming system for preforming a formed part from environmentally-friendly-degradable fiber material in a fiber-forming process, comprising

- a reservoir with a pulp as a liquid solution with the environmentally-friendly-degradable fiber material for molding (in the molding station described herein) the formed part, preferably arranged as a horizontal reservoir open at the top; and
- a prepressing station for preforming the formed part molded by means of a molding station according to one of the preceding claims by means of a suction tool with a prepressing pressure to reduce a portion of the liquid solution in the formed part and to stabilize the shape of the formed part.

The pulp can contain no organic binder, preferably also no non-organic binder. Without a binder, the formed parts produced from originally environmentally-friendly-degradable fiber material are degradable in a particularly environmentally-friendly manner, since no environmentally-critical binder, preferably no binder at all, is used. The elimination of binders is made possible by the combination of molding, preforming and hot-pressing steps, which as a whole ensure good mechanical interlinking of the individual fibers with one another in the fiber material of the formed part. In the process described herein, the mechanical interlinking is so strong that for the dimensional stability of the formed part binders can be dispensed with. In one embodiment, the environmentally-friendly-degradable fiber material essentially consists of fibers with a fiber length of less than 5 mm. With fibers of this length, one obtains, among other things, a good, homogeneous solution of the fiber material in the liquid solution, so that the degree of clumping of the fibers in the pulp is sufficiently low for a good, reproducible fiber-forming process for the formed part. In one embodiment, the pulp is provided at a temperature of less than or equal to 80° C., preferably less than or equal to 50° C., particularly preferably at room temperature. These low temperatures allow, among other things, a simple process control, especially at room temperature. At higher temperatures, the hot-pressing process can be slightly accelerated.

By means of the preforming station, a preformed part that is sufficiently stable for further processing and has a further reduced proportion of liquid solution is produced in a simple manner from a mechanically still unstable part by means of prepressing. Here, too, the ratio of the width or diameter to the height of the formed part does not represent a limiting or critical parameter for the quality of the production of the respective formed parts. The preforming station described herein makes it possible to produce and further process the formed parts in a very reproducible manner and with great accuracy and quality with regard to the shape and layer thickness of the individual formed part sections. In one embodiment, the prepressing can be performed at a temperature of the prepressing station of less than 80° C., preferably less than 50° C., particularly preferably at room temperature. The prepressing reduces the liquid content in the formed part to approx. 55%-65% and the formed part is pre-solidified in such a way that it is sufficiently dimensionally stable for tool transfer. Too high a temperature would lower the liquid content in the formed part too much, which would make the material too stiff for the subsequent hot-pressing. It is exactly the combination of prepressing and hot-pressing that enables the reproducible production of good-quality formed parts with a low level of rejects. In another embodiment, the prepressing is performed at the prepressing pressure between 0.2 $N/mm^2$ and 0.3 $N/mm^2$, preferably between 0.23 $N/mm^2$ and 0.27 $N/mm^2$. These moderate pressures, which are lower than the hot-pressing pressure, enable gentle solidification of the formed part with a moderate reduction in liquid, which is advantageous for a low-waste hot-pressing process.

In particular, this way, stable formed parts can be produced easily, effectively and flexibly from environmentally-friendly-degradable fiber material with good quality and good reproducibility.

The preforming station described herein, together with preceding and subsequent forming steps described herein, thus makes it possible to produce environmentally-friendly formed parts from natural fibers in an effective, flexible and reproducible manner with good quality.

In one embodiment, the preforming station further comprises a pulp preparation and replenishment unit for replenishing the pulp for the reservoir. In this way, the pulp can be fed to the reservoir with controlled quality and constant concentration as it is consumed by molding. The liquid solution discharged during molding can thus be returned to the reservoir after processing, for example, by adding fiber material to set the desired concentration of fiber material in the pulp, and can thus be reused in the fiber-forming process. In a further embodiment, the pulp preparation and replenishment unit therefore fills the reservoir at least periodically, preferably continuously, depending on the pulp consumed by molding the formed part, in order to ensure that the reservoir is filled to the required level for molding.

In a further embodiment, the prepressing station is arranged and configured relative to the reservoir in such a way that the liquid solution removed from the formed part by the prepressing is fed back into the reservoir. In this way, pulp consumption can be reduced. In a further embodiment, the prepressing station is arranged in a vertical alignment thereto above the reservoir, so that the liquid solution removed from the formed part by the prepressing flows back into the reservoir from the prepressing station directly into the reservoir. Alternatively, the liquid solution flows back into the reservoir after preparation by the pulp preparation and replenishment unit of the preforming station.

In a further embodiment, the prepressing station comprises a prepressing lower tool, the shape of which is adapted to the formed part remaining in the suction tool in such a way that it can be placed on the prepressing lower tool in such a way that it is arranged between the prepressing lower tool and the suction tool, so that the suction tool can be pressed onto the prepressing lower tool with prepressing pressure. The suction tool can be pressed onto a stationary prepressing lower tool or the prepressing lower tool is pressed onto a stationary suction tool. The term "place" only refers to the relative movement of the suction tool to the prepressing lower tool. During prepressing, the suction tool represents the prepressing upper tool of the prepressing station. In one embodiment, the suction tool is placed on the prepressing lower tool and pressed onto the prepressing lower tool by means of a separate pressing unit, preferably a piston rod. Alternatively, the suction tool can also be attached to a robotic arm, which itself exerts the prepressing pressure on the prepressing lower tool via the suction tool. Analogously to a suction tool as a multi-tool, the prepressing station can also be designed as a multi-tool with a plurality of prepressing lower tools adapted to the suction tool as a multi-tool in order to apply the prepressing pressure to all molded formed parts of the suction tool simultaneously and thus the carry out the prepressing for all formed parts simultaneously. Alternatively, the prepressing can be performed as membrane pressing, wherein the prepressing lower tool is designed as a flexible membrane and the prepressing pressure is applied to the membrane as gas pressure, which membrane is then pressed onto the outer contour of the formed part. Membrane pressing is particularly suitable for geometries of the formed part where pressure is to be exerted on a large area. Membrane pressing can also be used to simultaneously apply the same pressure to surfaces that are perpendicular to one other in any spatial orientation, since in membrane pressing the prepressing pressure is generated by means of gas pressure, for example, by means of compressed air, which acts on the membrane irrespective of the direction. This would not be possible with a pressure piston rod, for example. Rubber membranes, for example, can be used as membranes. The membrane should have a contour fidelity of less than 20% and can be designed differently locally, for example, with thinner and thicker walls and/or arranged closer to the contour or further away from it.

In a further embodiment, the prepressing lower tool has a pressing surface facing the formed part, the pressing surface having a lower surface roughness than the screen. As a result, homogeneous pressure is exerted on the formed part. In addition, the adhesion between the prepressing lower tool and the formed part is lower than with structured surfaces of the prepressing lower tool, which ensures that the prepressed formed parts remain in the suction tool for transfer to the hot-pressing station without further technical measures and do not remain on the prepressing lower tool, which would cause a disruption in the production process. If necessary, the suction tool can generate a suitable vacuum in the suction tool for the transfer of the prepressed formed parts to the hot-pressing station in order to improve the adhesion of the formed parts to the suction tool.

In a further embodiment, the prepressing lower tool is made of metal or at least partially made of elastomer, preferably made of silicone. Metal prepressing lower tools are particularly suitable for cases where a temperature above room temperature or a particularly high prepressing pressure is to be applied during prepressing. Prepressing lower tools made of an elastomer or at least partly made of elastomer are advantageous for multi-tools as suction tool and prepressing lower tool, since the elastomer can still be easily deformed under pressure and thus adapts flexibly to a multi-suction tool that may bend under the prepressing pressure and thus improves the homogeneity of the shaping of the various formed parts in the multi-suction tool. For increased prepressing temperatures below 100° C., for example, silicone as an elastomer is also well suited as a temperature-resistant material in this range.

In a further embodiment of prepressing lower tools, at least partially made of elastomer, said prepressing lower tools have a cavity which is surrounded by a wall made of the elastomer as a pressing surface, wherein the prepressing station is configured to apply gas pressure to the cavity during prepressing in order to generate the prepressing pressure or at least support it. This "inflating" of the prepressing lower tool allows it to conform particularly well to the contour of the formed part, so that the quality of the preforming process is improved, particularly for the reproducible production of very identical formed parts.

In a further embodiment, the prepressing lower tools are arranged on a common carrier plate, which is configured as an interface to the prepressing station for reversible attachment to the prepressing station and/or for supplying the individual prepressing lower tools with gas pressure. Among other things, this means that the prepressing lower tool can also be quickly exchanged as a multi-tool if required.

In a further embodiment, the carrier plate additionally comprises a heating element, preferably a heating element extending over the surface of the carrier plate, for heating the lower prepressing tools. This modular structure facilitates the handling of the components and their exchangeability.

In a further embodiment, the molding station is part of the preforming station. As a result, the molding station can be connected to the preforming station via suitable lines in such a way that the liquid solution and/or fiber material that has passed through the suction head is fed back into the pulp via the preforming station.

In a further embodiment, the suction tool having the negative form as the suction head suction side is placed on the prepressing lower tool (with a corresponding positive form) or having the positive form as the suction head suction side is inserted in the prepressing lower tool (as a corresponding negative form).

The object is achieved according to a third aspect of the present disclosure by a hot-pressing station for a fiber-forming system for the final shaping of a formed part made of environmentally-friendly-degradable fiber material in a fiber-forming process, comprising a hot-pressing lower tool adapted to a contour of the formed part for receiving the formed part and a hot-pressing upper tool adapted accordingly to the formed part for placing onto or inserting into the formed part along a closing direction of the hot-pressing station, wherein the hot-pressing lower tool and/or the hot-pressing upper tool are provided for exerting a hot-pressing pressure on the formed part arranged between the hot-pressing lower tool and the hot-pressing upper tool during hot-pressing.

After prepressing has taken place, the preformed formed part is transferred to the hot-pressing station by means of the suction tool, with the formed part being removed from the suction tool for subsequent hot-pressing. The transfer is advantageous in that the hot-pressing is performed at a high temperature with a significantly higher pressure. If the formed part were to remain in the suction tool without being transferred for hot-pressing, the fiber material could get caught in the screen of the suction tool and, after hot-pressing, be removed from the suction tool only with difficulty, possibly only with damage. In addition, the screen could be damaged by the high pressure, so that the suction tool would then no longer be functional. The transfer can take place in such a way that the formed part or parts are transferred from the suction tool to the hot-pressing station either passively by depositing them or actively by means of an ejection pressure in the suction tool against the formed parts. With the hot-pressing of the prepressed formed part with a hot-pressing pressure, the formed part is final-shaped with a further reduction in the proportion of the liquid solution in the formed part, for example, to below 10%, preferably to approximately 7%, after which it is then stable and dimensionally stable. Preferably, the hot-pressing lower and upper tools are made of metal. The hot-pressing is performed at the hot-pressing pressure which is higher than the prepressing pressure, for example, at a hot-pressing pressure between 0.5 $N/mm^2$ and 1.5 $N/mm^2$, preferably between 0.8 $N/mm^2$ and 1.2 $N/mm^2$. The hot-pressing pressure can be applied for a pressing time of less than 20 s, preferably more than 8 s, particularly preferably between 10 and 14 s, even more preferably 12 s. The hot-pressing pressure is applied hydraulically to the hot-pressing station, for example, via a piston rod, which piston rod presses, for example, on the hot-pressing upper tool, which in turn presses on the stationary hot-pressing lower tool, with the formed part in between. The arrangement could also be reversed.

The hot-pressing station is a simple way of producing a preformed and still slightly variable formed part by means of hot-pressing a final-shaped formed part with a significantly reduced proportion of liquid solution for further processing. Here, too, the ratio of the width or diameter to the height of the formed part does not represent a limiting or critical parameter for the quality of the production of the respective formed parts. The hot-pressing station described herein makes it possible to produce and further process the formed parts in a very reproducible manner and with great accuracy and quality with regard to the shape and layer thickness of the individual formed part sections. In particular, it is possible in this way to produce end-stable formed parts in a simple, effective and flexible manner from environmentally-friendly-degradable fiber material with good quality and good reproducibility.

The hot-pressing station described herein, together with previous forming steps described herein, thus makes it possible to produce environmentally-friendly formed parts made of natural fibers in an effective, flexible and reproducible manner with good quality.

In one embodiment, in the case of a negative form of a suction tool, the hot-pressing lower tool also has a negative form and is provided as an inner tool, while the hot-pressing upper tool is placed on it as an outer tool for hot-pressing. In the case of a positive form of the suction tool, the hot-pressing lower tool also has a positive form and is provided as an outer tool, while the hot-pressing upper tool is inserted in the hot-pressing lower tool as an inner tool for hot-pressing. The two hot-pressing upper and lower tools can work together to apply high pressures at high temperatures to the formed part in between them.

In a further embodiment, the respective hot-pressing sides of the hot-pressing lower tool and the hot-pressing upper tool facing the formed part are heated by means of electric heating cartridges. Electric heating cartridges enable rapid heating of the hot-pressing lower tool and the hot-pressing upper tool when the tools are closed, after the tools have cooled down by opening the hot-pressing station to remove the final-shaped parts.

In a further embodiment, the heating cartridges in the hot-pressing lower tool and hot-pressing upper tool are configured and arranged in such a way that the hot-pressing sides are heated to temperatures greater than 150° C., preferably between 180° C. and 250° C. This means that the liquid (or moisture) in the formed part can be reduced quickly and reliably to below 10%.

In a further embodiment, the heating cartridges are controlled in such a way that the temperatures of the hot-pressing lower tool and the hot-pressing upper tool differ. Among other things, this gives the formed part a better surface, especially on the warmer side. Preferably, the hot-pressing upper tool has a higher temperature than the hot-pressing lower tool; the temperatures preferably differ by at least 25° C., preferably not more than 60° C., particularly preferably by 50° C.

In a further embodiment, the heating cartridges are arranged close to the contour of the formed part in the respective hot-pressing upper tools and hot-pressing lower tools. The heating cartridges that are close to the contour heat the hot-pressing side up to the process temperature more quickly, which speeds up the hot-pressing process. The respective hot-pressing upper tools and hot-pressing lower tools are preferably made of metal in order to support this by means of good heat conduction.

In a further embodiment, at least one heating cartridge with a first heating output is arranged in the inner tool, while a plurality of heating cartridges with second heating outputs are arranged in the outer tool around the hot-pressing side of the outer tool. With this arrangement, rapid heating is achieved with the smallest possible number of heating cartridges. For this purpose, the first heating output is preferably greater than the second heating output. In a further embodiment, in the case of a single heating cartridge in the inner tool, said heating cartridge is arranged centrally in the inner tool parallel to the closing direction, and/or in the case of several heating cartridges, said heating cartridges are arranged in the inner tool concentrically around the closing direction parallel to the hot-pressing side of the inner tool. In a further embodiment, a plurality of heating cartridges is arranged in the outer tool concentrically around the closing direction and parallel to the hot-pressing side of the outer tool.

In a further embodiment, the hot-pressing lower tools and/or the hot-pressing upper tools comprise a covering made of a thermally insulating material on the sides facing away from the formed part, to keep the process temperature as constant as possible and to keep the necessary heating output of the heating cartridges as low as possible.

In a further embodiment, the hot-pressing lower tool comprises channels on its hot-pressing side, with which the liquid solution can be at least partially discharged during hot-pressing. By reducing the liquid (or moisture) in the formed part from approx. 55%-60% to below 10%, a quantity of liquid is released, which at least partially evaporates due to the high temperatures during hot-pressing. This steam is discharged via the channels so that the formed part is not damaged by the steam, among other things. For this purpose, the channels preferably have a diameter of less than or equal to 1.0 mm, at least on the hot-pressing side.

In a further embodiment, both the hot-pressing lower tool and the hot-pressing upper tool are designed as a multi-tool with a plurality of hot-pressing lower tools and hot-pressing upper tools arranged on respective carrier plates for the respective hot-pressing lower tools and hot-pressing upper tools. In this way, after the transfer, the hot-pressing pressure can be applied to all preformed formed parts from the suction tool simultaneously, and the hot-pressing can thus be performed simultaneously for all formed parts.

In a further embodiment, the carrier plates in the hot-pressing station are laterally movably mounted to facilitate a tool change of the respective hot-pressing lower tools and hot-pressing upper tools as multi-tools outside of a process space of the hot-pressing station. This means that changes can be performed quickly and in a space-saving manner.

In a further embodiment, the carrier plate of the hot-pressing upper tools of the multi-tool is provided with gas lines in order to, depending on the process step, apply a vacuum in the respective hot-pressing upper tools to hold the formed parts in and/or an overpressure to eject the final-shaped formed parts from the hot-pressing upper tools.

In a further embodiment, expansion means are arranged between the carrier plate and a holder for the carrier plate to compensate for high temperatures and temperature fluctuations due to the opening and closing of the hot press station relative to the supports and other components.

In a further embodiment, thermally insulating material is arranged between the carrier plate and the holder in order to keep the process temperature as constant as possible and to keep the necessary heating output of the heating cartridges as low as possible.

The present disclosure also relates to a fiber-forming system for producing formed parts from environmentally-friendly-degradable fiber material, comprising at least a molding station described herein, a preforming station described herein, and a hot-pressing station described herein for producing a formed part from environmentally-friendly-degradable fiber material by means of a fiber-forming process performed in the fiber-forming system.

The combination of molding by means of pulp and a suction tool, prepressing by means of a preforming station, and hot-pressing by means of a hot-pressing station makes it easy to produce a formed part from a fiber material that, depending on the design of the contour of the suction head, can very flexibly deliver formed parts with a wide variety of contours. The ratio of width or diameter to height of the formed part does not represent a limiting or critical parameter for the quality of the production of the respective formed part. Through the combination of the suction tool for molding and the preforming and hot-pressing stations, the formed parts can be produced very reproducibly and with great accuracy and quality in terms of shape and layer thickness of the individual formed part sections. The fiber-forming system described herein is able to process fibers of the most varied types, provided that they can be dissolved in such a way that extensive clumping of the fibers in the liquid solution prior to processing can be avoided. In particular, this way, stable formed parts can be produced easily, effectively and flexibly from environmentally-friendly-degradable fiber material with good quality and good reproducibility.

The fiber-forming system described herein thus makes it possible to produce environmentally-friendly formed parts from natural fibers in an effective, flexible and reproducible manner with good quality.

In one embodiment, the fiber-forming system comprises a control unit for controlling at least the molding station, the preforming station and the hot-pressing station and their sub-components. The control unit can be designed as a processor, separate computer system or can be web-based and is suitably connected to the components of the fiber-forming system to be controlled, for example, via data cable or wirelessly using WLAN, radio or other wireless transmission means.

In a further embodiment, the fiber-forming system also comprises a coating unit for applying one or more functional coatings to the formed part. With such functional coatings, additional functionalities such as moisture, aroma, odor or taste barriers or barriers against fats, oils, gases such as O2 and N2, light acids and all substances that contribute to the perishability of food and/or non-food-grade substances are applied to the formed part. For this purpose, the coating unit can be arranged at any position in the process sequence for producing the formed part that is suitable for the coating to be applied. Depending on the application, the functional coating can be arranged in the suction process, after pre-pressing or after hot-pressing. The term "functional coating" refers here to any additional coating applied to the original fiber material that is applied both to an inner side and/or to an outer side of the formed part over the whole area or in partial areas.

In a further embodiment, the fiber-forming system additionally comprises an ejection unit for ejecting the final-shaped formed part. The ejection unit ejects the formed part for further transport or for further processing, for example, to subsequent cutting, inscribing, printing, stacking and/or packing stations, for example, with the aid of a conveyor belt.

The present disclosure also relates to a method for producing formed parts from environmentally-friendly-degradable fiber material by means of a fiber-forming process in a fiber-forming system described herein, comprising the following steps:

- molding the formed part in a molding station described herein from a reservoir with a pulp as a liquid solution with the environmentally-friendly-degradable fiber material;
- preforming the formed part in a preforming station described herein;
- final shaping the preformed part in a hot-pressing station described herein; and
- ejecting the final formed part from the fiber-forming system.

It should be expressly pointed out that, for the purpose of better readability, "at least" expressions have been avoided as far as possible. Rather, an indefinite article ("one", "two" etc.) is normally to be understood as "at least one, at least two, etc.", unless it follows from the context that "exactly" the specified number is meant there.

At this point it should also be mentioned that within the scope of the present patent application, the expression "in particular" is always to be understood in such a way that an optional, preferred feature is introduced with this expression. The expression is therefore not to be understood as "specifically" and not as "namely".

It goes without saying that features of the solutions described above or in the claims can also be combined if necessary in order to be able to cumulatively implement the advantages and effects that can be achieved here.

BRIEF DESCRIPTION OF THE FIGURES

In addition, further features, effects and advantages of the present disclosure are explained with reference to the attached drawing and the following description. Components which at least essentially correspond in terms of their function in the individual figures are identified by the same reference signs, with the components not having to be numbered and explained in all figures.

In the figures.

DETAILED DESCRIPTION

Figure 1:
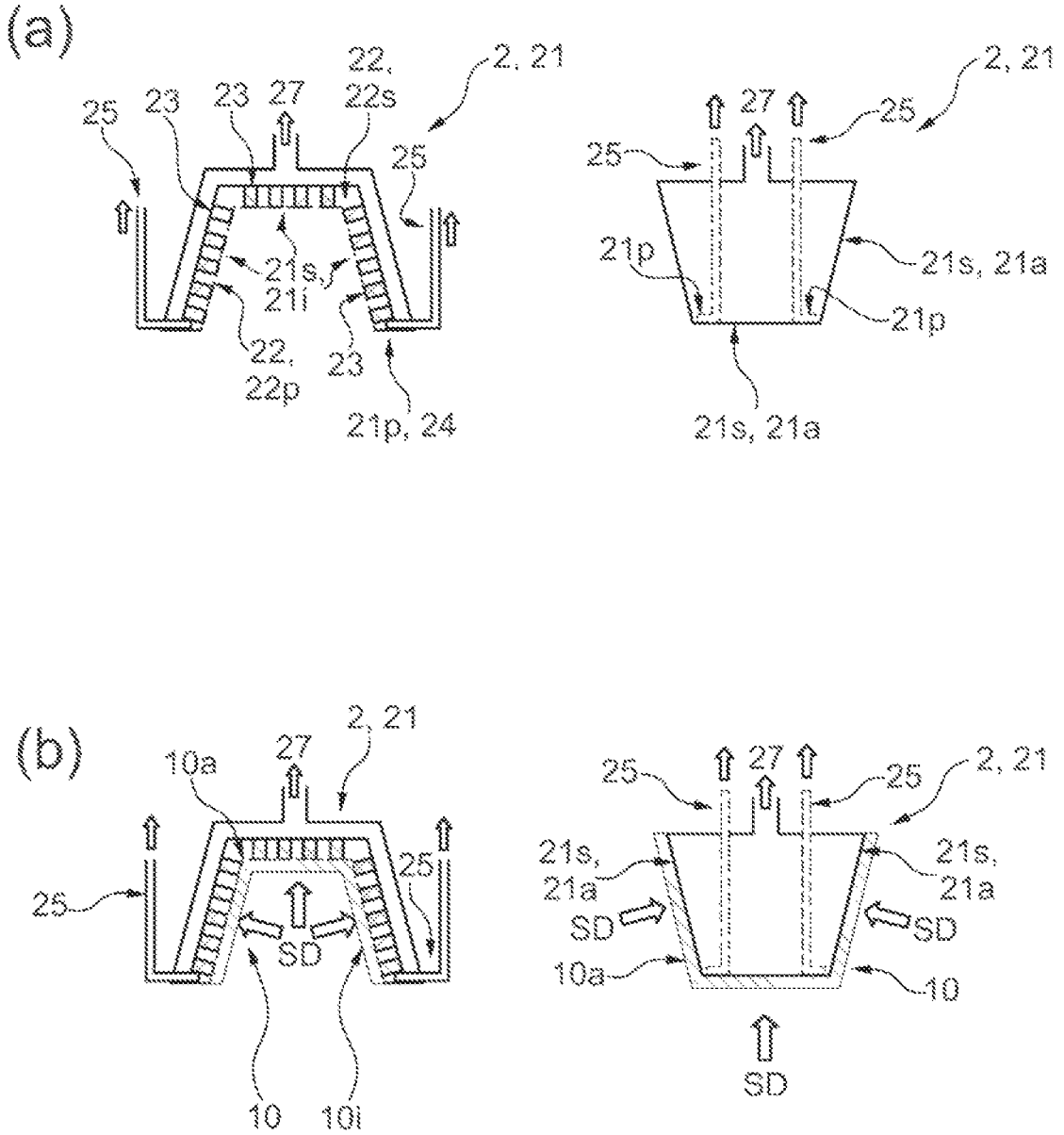
FIG. 1: shows an embodiment of the suction head with a negative and positive form (a) before molding and (b) after molding the formed part.

FIG. 1 shows an embodiment of the suction head with negative and positive form (a) before molding and (b) after molding the formed part in a molding station 20 of a fiber-forming system 100 for molding 210 a formed part 10 from environmentally-friendly-degradable fiber material 11. The molding station is described globally in FIG. 6, while only the suction tool 2 for sucking in, from a reservoir 6 with a pulp 1 as a liquid solution with the environmentally-friendly-degradable fiber material 11, the environmentally-friendly-degradable fiber material 11 for molding 210 the formed part 10 is discussed, wherein the suction tool 2 comprises a suction head 21 with a three-dimensionally shaped suction head suction side 21*s*, the shape of which is adapted to a contour 10*i*, 10*a* of the later formed part 10, and the formed part 10 is molded on the suction head suction side 21*s* by means of a vacuum in the suction tool 2. The suction head suction side 21*s* of the suction head 21 is formed from a porous screen 22, on whose pulp side 22*p* facing the pulp 1 the environmentally-friendly-degradable fiber 11 adheres due to the suction for molding 130 the formed part 10 (see formed part 10 in FIG. 2*c*). For this purpose, the suction tool 2 comprises a plurality of suction channels 23, which terminate on the suction-side surface 23*s* below the screen 22 and is distributed over the suction-side surface 23*s* in such a way that essentially the same suction power is made possible in all areas between the screen 22 and the suction-side surface 23*s*. For this purpose, the suction channels 23 can have openings in the suction-side surface 23*s* with diameters of less than 4 mm. The cross-sectional area of the suction channels 23 can have any suitable shape, for example, the cross-sectional area can be circular or oval. For this purpose, the suction channels 23 also have an uneven distribution on the suction-side surface 23*s*, wherein in the area of negative edges in the formed part 10 by 40%-60% fewer and/or in the area of positive edges 10%-30% more suction channels 23 per unit area are arranged than with plane surfaces. The suction head for molding the formed part only needs to be slightly immersed in the pulp 1, so that a closed cavity is formed in the interior 21*i* of the suction head. In other embodiments, the suction head 21 could also be completely immersed in the pulp 1. The liquid solution of the pulp 1 passing through the screen 22 during the molding 130 is discharged from the suction tool 2. For this purpose, the suction head 21 comprises on its end face 21*p* facing the pulp 1 a collecting ring 24 for receiving the liquid solution of the pulp 1 sucked through the suction head suction side 21*s*, which collecting ring is connected to a discharge channel 25 for the liquid solution. The suction head suction side 21*s* of the suction head 21 can be designed either as a negative form (left part of FIG. 1) as the suction head inside 21*i* or as a positive form (right part of FIG. 1) as the suction head outside 21*a*. In the case of a negative form, the formed part 10 (gray inner layer in the suction head 21, FIG. 1*b* left) which is formed toward the inside 21*i* of the suction head by means of the suction pressure SD is placed on the prepressing lower tool 31 with a pressing surface 31*a* as the outer surface of the prepressing lower tool 31 for prepressing. With a positive form, the suction head 21 is completely immersed in the pulp 1 for contacting 120 to suck up the pulp 1 with the fiber material 11. Thereafter, the formed part 10 (gray outer layer on the suction head 21, FIG. 1*b* right) which is formed on the outside of the suction head 21*a* due to the suction pressure SD is inserted for prepressing into the prepressing lower tool 31, which has a shape adapted to the positive form of the suction head 21 with a pressing surface 31 as an inner surface of the prepressing lower tool 31. The suction head 21 further comprises a gas line system 27, which supplies the vacuum provided to the suction head 21 as suction pressure SD.

Figure 2:
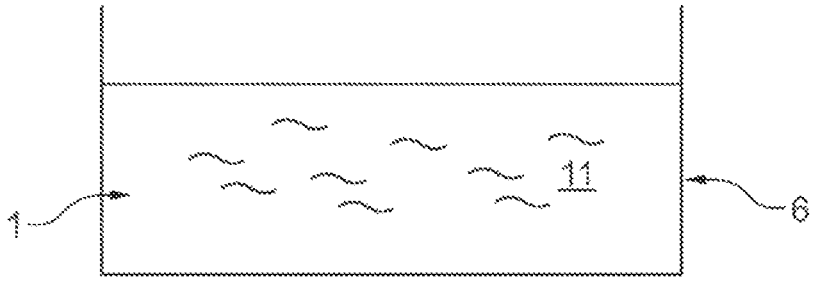
FIG. 2: shows an embodiment of the pulp reservoir with pulp.

FIG. 2 shows an embodiment of the pulp reservoir 6 with pulp, where the environmentally-friendly-degradable fiber material 11 is indicated as "waves". The pulp 1 can contain less than 5%, preferably less than 2%, particularly preferably between 0.5% and 1.0% of environmentally-friendly, degradable fiber material 11 in a liquid solution, for example, an aqueous solution. Advantageously, the pulp 1 does not include any organic binder, preferably no binder at all. The environmentally-friendly-degradable fiber material 11 can essentially consist of fibers with a fiber length of less than 5 mm. The pulp 1 is provided at a temperature of less than or equal to 80° C., preferably less than or equal to 50° C., particularly preferably at room temperature.

Figure 3:
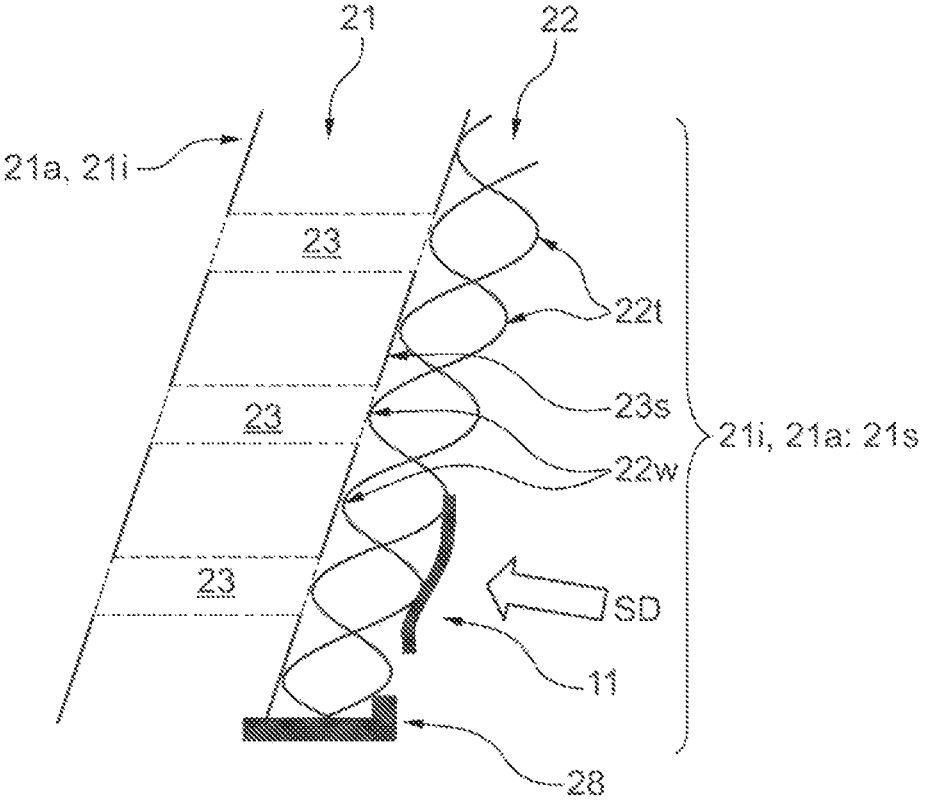
FIG. 3: shows an embodiment of the suction head according to some embodiments as a lateral section.

FIG. 3 shows an embodiment of the suction head 21 according to some embodiments as a lateral section, the screen 22 having a wavy structure with wave crests 22*w* and wave troughs 22*t* along the suction-side surface 23*s*. The screen 22 rests with the wave crests 22*w* of its side 22*s* facing the suction-side surface 23*s* during suction and is thus mechanically supported in its shape by the suction-side surface 23 so that the screen 22 does not change geometrically during the molding process and therefore ensures a shape accuracy for the formed part that is subsequently formed. The screen 22 is fastened in the suction head 21

(indicated on the lower side) with a reversible fastening means 28, designed here as clamping means, to the suction head 21. Additionally or alternatively, the screen 22 could also be fastened in at least some of the suction channels 23. Furthermore, the fiber 11 is an example of the molded fiber material 11, indicating how the fiber material 11 molds on the screen 22, so that the formed part is molded as a whole as a result of the suction of the pulp.

Figure 4:
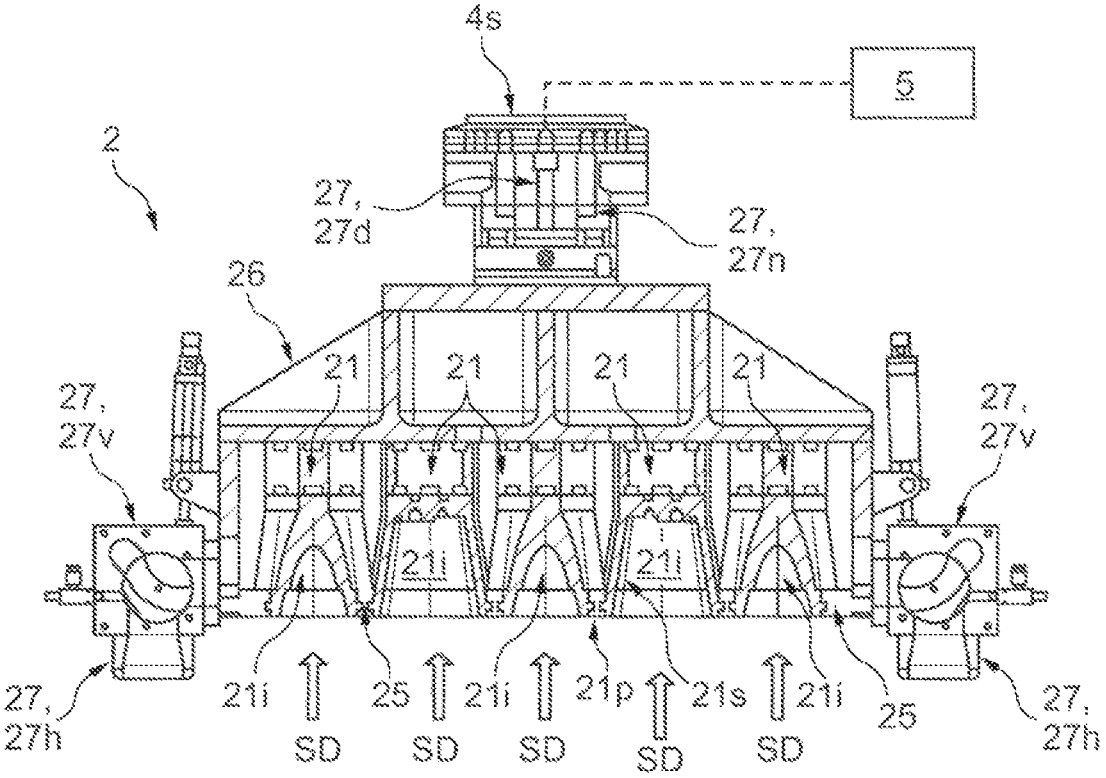
FIG. 4: shows an embodiment of the suction tool according to some embodiments in lateral section.

FIG. 4 shows an embodiment of the suction tool 2 according to some embodiments in a lateral section. In this case, the suction tool 2 is a multi-tool with a plurality of suction heads 21. These suction heads are arranged on the suction side in a two-dimensional arrangement with four rows of 5 suction heads each. In other embodiments, multi-tools 2 can also have different numbers of rows and columns of suction heads 21. The suction tool 2 here comprises a base plate 26 with suction heads 21 mounted thereon and a gas line system 27 in the base plate 26. The base plate 26 is not to be understood here as a thin plate, but refers to the rear structure of the suction tool 2, which serves to connect the movement unit 4 and the suction heads 21. The gas line system 27 distributes the vacuum provided by a vacuum pump 5 as suction pressure SD to the suction heads 21 for sucking in the fiber material 11. The gas line system 27 here also comprises a compressed gas line 27*d* for applying compressed air to the suction heads 21 in order, for example, to release or eject the molded or preformed formed parts 11 from the suction heads 21. The gas line system 27 for the vacuum (suction pressure) for molding the formed parts 11 comprises one or more main gas lines 27*h* and secondary gas lines 27*n*, wherein the main gas lines 27*h* are provided for generating a pre-vacuum and the secondary gas lines 27*n* are provided as a supplement to the main gas lines 27*h* for achieving the suction pressure SD after contacting the suction tool 21 with the pulp 1. The main gas lines preferably have a large cross section, while the secondary gas lines have a smaller cross section. One or more valves 27*v* (here two valves 27*v* in the main gas line 27*h*) are arranged in the gas line system 27 to switch off the suction pressure SD at the suction heads 21 as soon as the suction tool has left the pulp 1 and/or to at least switch the secondary gas lines to the main lines as soon as the suction tool 2 is immersed in the pulp 1. The multi-tool 2 is connected to the robotic arm 4*a* via the interface 4*s*, comprising all media supply connections for the suction tool 2 with the movement unit 4. Movement unit 4 and suction tool 2 are configured to eject the formed parts 10 from the suction heads 21 of the suction tool 2 by means of compressed air provided by the compressed gas line 27*d* and distributed to the individual suction heads 21 via the base plate 26.

Figure 5:
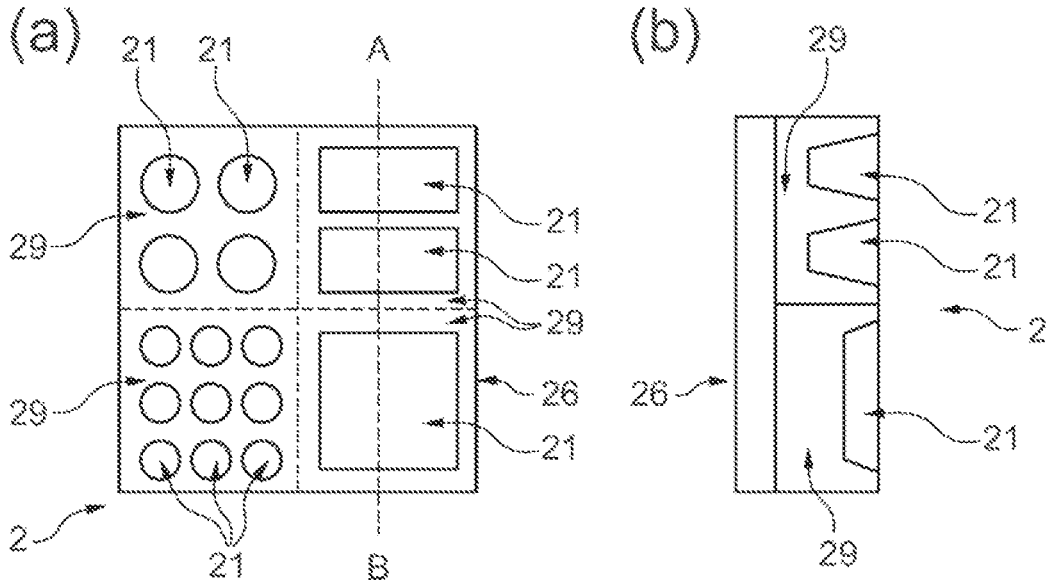
FIG. 5: shows a further embodiment of the suction tool according to some embodiments with modules (a) in plan view of the suction side and (b) in lateral section along the cutting plane A-B.

FIG. 5 shows a further embodiment of the suction tool 2 according to some embodiments with modules 29 (*a*) in a plan view of the suction side and (b) in a lateral section along the cutting plane A-B. The individual shapes of the suction heads 21 in the suction tool 2 as a multi-tool can differ at least in part, with the same shapes of the suction heads 21 being arranged adjacently in the suction tool 2 in respective separate modules 29. For example, in a first module 29 there are four suction heads for the production of larger cups, in a second module 29 six suction heads for the production of smaller cups, in a third module 29 two suction heads for the production of smaller bowls and in a fourth module 29 one suction head for the production of a larger bowl.

Figure 6:
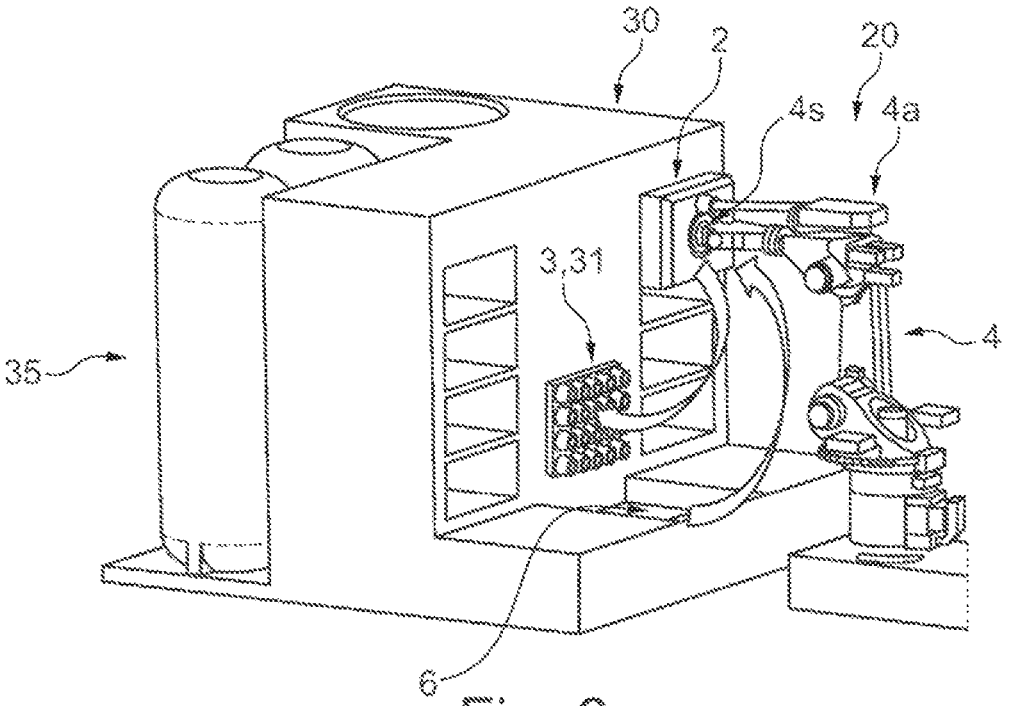
FIG. 6: shows an embodiment of the molding and preforming stations according to some embodiments.

FIG. 6 shows an embodiment of the molding and preforming stations 20, 30 according to some embodiments, with the molding station 20 being part of the preforming station 30 here. The molding station 20 comprises the suction tool 2 (designed here as a multi-tool) for sucking in the environmentally-friendly-degradable fiber material 11 for molding 210 the formed part 10 out of a reservoir 6 with a pulp 1 as a liquid solution with the environmentally-friendly-degradable fiber material 11 (further details on the suction head see FIGS. 1-5) and a movement unit 4, on which the suction tool 2 is mounted, and which is provided at least for placing or for partially immersing the suction tool 2 on or in the pulp 1. The preforming station 30 comprises the reservoir 6 with the pulp 1 as a liquid solution with the environmentally-friendly-degradable fiber material 11 for molding the formed part 10 in the suction tool 2, arranged as a horizontal reservoir 6 that is open at the top, and a prepressing station 3 (designed here as a multi-tool) for preforming 220 of the formed part 10 already molded by means of the molding station 20 with a prepressing pressure VD for reducing a proportion of the liquid solution in the formed part 10 and for stabilizing the shape of the formed part 10. Furthermore, the preforming station 30 comprises a pulp preparation and replenishment unit 35 for replenishing the pulp 1 for the reservoir 6. For example, in the preparation and replenishment unit 35, the pulp is premixed from a solvent and a fiber material 11, finally mixed to form the production pulp 1, fed into the reservoir and/or reused from returns from the suction tool 2 and/or the prepress station 3, wherein, in this case, the proportion of the fiber material 11 has to be reset to the desired proportion so that the production pump does not thin out the fiber material 11 during the ongoing process. For this purpose, the pulp preparation and replenishment unit 35 comprises one or more containers (two shown here) for solvent and mixed pulp as well as a depot for the fiber material 11. The pulp preparation and replenishment unit 35 fills the reservoir 6 at least periodically, preferably continuously, as a function of the consumption of pulp by the molding of the formed part 10, in order to achieve a required fill level of the reservoir 6 and the desired proportion of fiber material 11 in the pulp 1 for molding. The prepressing station 3 can be arranged relative to the reservoir 6 and configured in such a way that the liquid solution removed from the formed part by the prepressing is fed back into the reservoir 6. For this purpose, the prepressing station 3 can be arranged in a vertical alignment above the reservoir 6 so that the liquid solution removed from the formed part by the prepressing flows back into the reservoir 6 from the prepressing station 3 directly into reservoir 6. In addition, the molding station 20 can be connected to the preforming station 30 via suitable lines (not shown here) in such a way that the liquid solution and/or fiber material 11 that has passed through the suction head 21 via the preforming station 30 is fed back into the pulp 1 by means of the pulp preparation and replenishment unit 35. The movement unit 4 here comprises a robotic arm 4*a* that can move freely in space and on which the suction tool 2 is mounted. The robotic arm 4*a* is connected to the suction tool 2 with a suitable interface 4*s* comprising all media supply connections for the suction tool 2. Depending on the application and the process, the movement unit 4 can be provided to completely immerse the suction heads 21 into the pulp 1 for contacting 120. The movement unit 4 is provided for transferring the formed parts 10 in the suction tool 2 to the prepressing station 3 of the preforming station 30 and to the hot-pressing station 40 and to eject them for the hot-pressing process at the latter. The movement unit 4 and the suction tool 2 are configured to leave the formed parts 10 in the suction tool 2 in the prepressing station 3. The prepressing is thus performed with a prepressing lower tool 31 and the suction tool 2 as the prepressing upper tool. In this case, the prepressing pressure can be exerted on the formed parts between the prepressing lower tool 31 and the suction tool 2, for example, by means of a hydraulically operated piston rod or by means of the robotic arm. The prepressing can be performed at a temperature of the prepressing station 3 of less than 80° C., preferably less than 50° C., particularly preferably at room temperature, wherein the prepressing pressure VD is between 0.2 $N/mm^2$ and 0.3 $N/mm^2$, preferably between 0.23 $N/mm^2$ and 0.27 $N/mm^2$. In an alternative embodiment, the prepressing (preforming) can also be performed with a membrane 32 as a prepressing lower tool 31 as a membrane press (not shown here). The suction tool 2 would then be inserted into the correspondingly shaped prepressing lower tool 31 with a positive form as the suction head suction side 21*s*. For membrane pressing 150, the membrane 32 would be configured as a flexible membrane. The prepressing pressure VD would be applied as gas pressure to the membrane 32 which is then pressed onto the outer contour of the formed part 10. As a result, pressure can also be exerted on surfaces of the formed part 10 that cannot be applied in this way by means of hydraulic pressing, since the gas pressure applies the membrane to all surfaces with the same pressure, independent of direction. The movement unit 4 and the suction tool 2 are also designed to eject the formed parts 10 in the hot-pressing station from the suction tool 2 for the subsequent hot-pressing. This can be done, for example, by means of compressed air, which ejects the formed parts 10 from the suction heads 21 of the suction tool 2.

Figure 7:
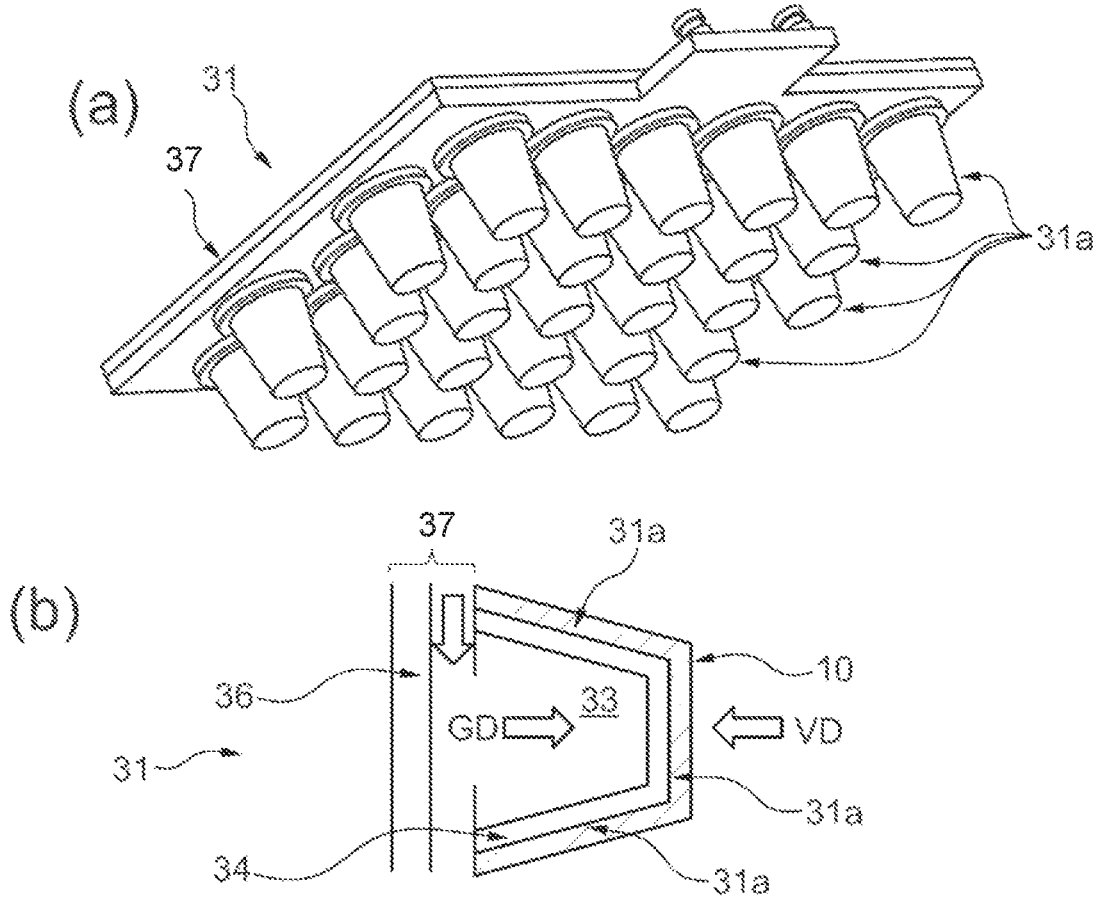
FIG. 7: shows an embodiment of the prepressing lower tool according to some embodiments as a multi-tool (a) in perspective view of the multi-tool and (b) in lateral section of a single prepressing lower tool in the multi-tool.

FIG. 7 shows an embodiment of the prepressing lower tool according to some embodiments as a multi-tool with a plurality of pressing surfaces 31*a* adapted to the suction tool 2 (*a*) in a perspective view of the multi-tool and (b) in a lateral section of an individual prepressing lower tool in the multi-tool. The prepressing lower tool 31 is adapted here to a negative form of the suction heads 21 so that the formed part 11 can be placed onto the prepressing lower tool 31 in such a way that it is arranged between the prepressing lower tool 31 and the suction tool 2 so that the suction tool 2 can be pressed onto the prepressing lower tool 31 with the prepressing pressure VD. In this case, the prepressing lower tool 31 has a pressing surface 31*a* facing the formed part 10, which has a lower surface roughness than the screen 22 of the suction tool 2. The prepressing lower tool 31 can be made of metal, for example, or at least partially of an elastomer, preferably silicone. In the embodiments shown here, the prepressing lower tool 31 is made in part from an elastomer, in this case silicone. The prepressing lower tool 31 has a cavity 33 which is surrounded by a wall 34 made of the elastomer as a pressing surface 31*a*, wherein the prepressing station 3 is configured to apply gas pressure GD to the cavity 33 during prepressing in order to generate the prepressing pressure VD on the formed part 10 and suction tool 2 or at least to support the prepressing pressure exerted by the suction tool 2 with the gas pressure GD directed in the opposite direction (see FIG. 7*b*). In the multi-tool, the individual pressing surfaces 31*a* are arranged on a common carrier plate 37, which is equipped as an interface to the prepressing station 3 for reversible attachment to the prepressing station and/or for supplying the individual pressing surfaces 31*a* with gas pressure. Here, the carrier plate 37 also has a heating element 36 which extends over the surface of the carrier plate 37 in order to enable the pressing surfaces 31*a* to be heated.

Figure 8:
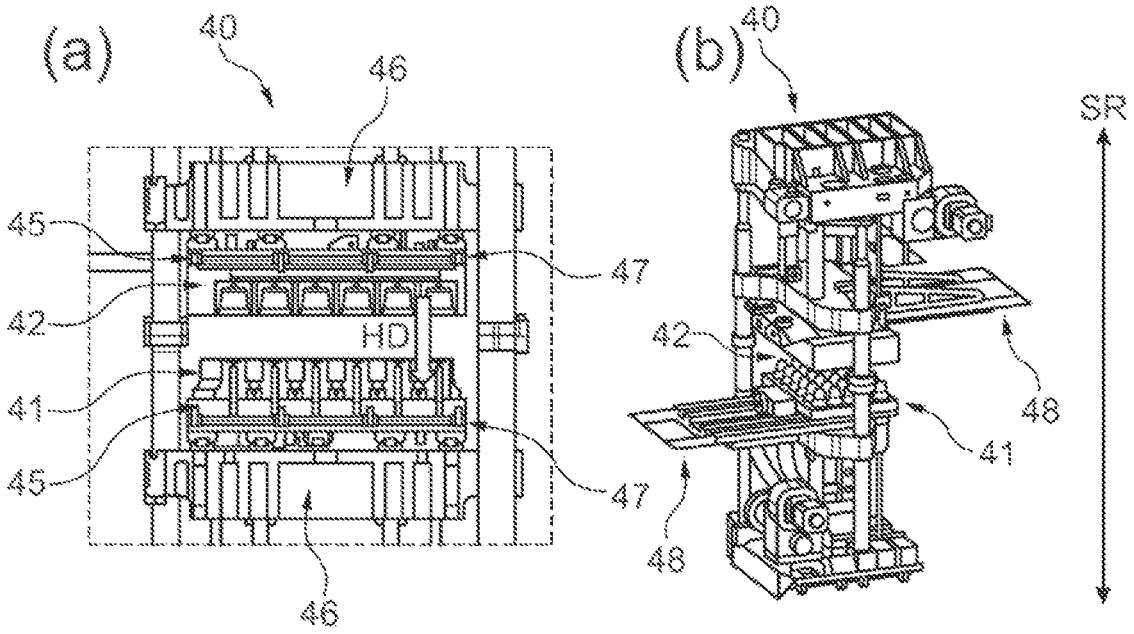
FIG. 8: shows a further embodiment of the hot-pressing station according to some embodiments (a) in side view and (b) in perspective view.

FIG. 8 shows a further embodiment of the hot-pressing station 40 according to some embodiments (a) in side view and (b) in perspective view comprising a hot-pressing lower tool 41 adapted to a contour 10*i* of the formed part 10 for receiving the formed part 10 and a hot-pressing upper tool 42, correspondingly adapted to the formed part 10, for placing onto or inserting into the formed part 10 along a closing direction SR of the hot-pressing station 40, wherein the hot-pressing lower tool 41 and the hot-pressing upper tool 42 apply a hot-pressing pressure HD to formed part 10 arranged between the hot-pressing lower tool 41 and the hot-pressing upper tool 42 during hot-pressing. In the case of a negative form of a suction tool 2, the hot-pressing lower tool 41 also has a negative form (as shown here) and is thus provided as an inner tool 40*i* in the hot-pressing station 40, while the hot-pressing upper tool 42 is placed on it as an outer tool 40*a* for hot-pressing. In the case of a positive form of the suction tool 2 (not shown here), the hot-pressing lower tool 41 would also have a positive form and would be provided as an outer tool 40*a*, while the hot-pressing upper tool 42 would be inserted in the hot-pressing lower tool 41 as an inner tool 40*i* for hot-pressing. The hot-pressing lower tool 41 and the hot-pressing upper tool 42 are designed here as complementary multi-tools with a plurality of hot-pressing lower tools 41 and hot-pressing upper tools 42 arranged on respective carrier plates 45 for the respective hot-pressing lower tools 41 and hot-pressing upper tools 42. The carrier plates 45 are laterally movably mounted in the hot-pressing station 40 (see FIG. 8*b*) to enable the respective hot-pressing lower tools 41 and hot-pressing upper tools 42 to be changed as multi-tools outside of a process space of the hot-pressing station 40. The carrier plate 45 of the hot-pressing upper tools 42 of the multi-tool is provided with gas lines in order to, depending on the process step, apply a vacuum in the respective hot-pressing upper tools 42 to hold the formed parts 10 in and/or an overpressure to eject the final-shaped formed parts 10 from the hot-pressing upper tools 42. The hot-pressing upper tool 42 can then be used to eject the final-shaped formed parts 10 for further transport, for example, onto a conveyor belt 95 connected to the hot-pressing station. For this purpose, the carrier plate 45 can be moved from the hot-pressing position into an ejection position. Furthermore, expansion means 47 for compensating for thermal expansion effects are arranged between the carrier plate 45 and a holder 46 for the carrier plate 45. Thermally insulating material 44 can be arranged between the carrier plate 45 and the holder 46, see, for example, FIG. 9.

Figure 9:
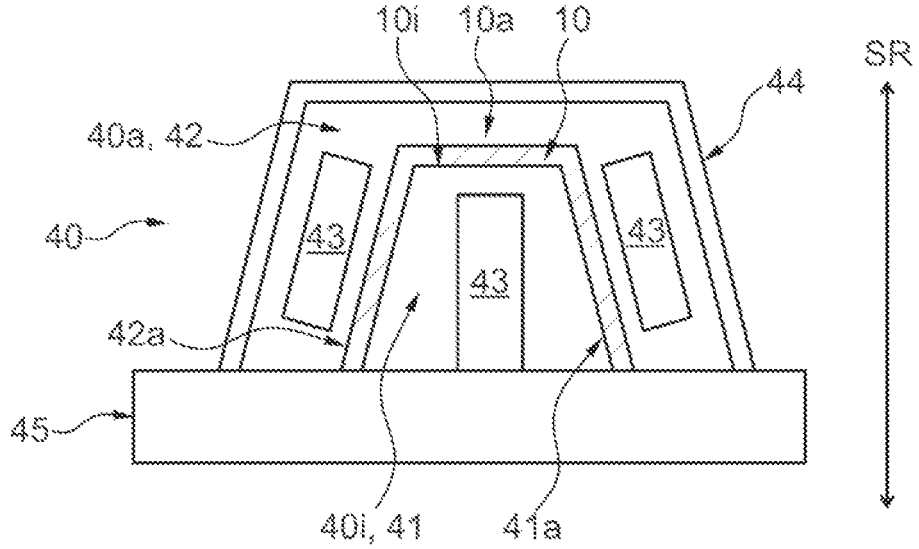
FIG. 9: shows a schematic representation of an embodiment of the hot-pressing lower tool and hot-pressing upper tool of the hot-pressing station from FIG. 8 during hot-pressing.

FIG. 9 shows a schematic representation of an embodiment of the hot-pressing lower tool 41 and hot-pressing upper tool 42 of the hot-pressing station 40 from FIG. 8 during hot-pressing. The respective hot-pressing sides 41*a*, 42*a* of the hot-pressing lower tool 41 and the hot-pressing upper tool 42 facing the formed part 10 are heated by means of electric heating cartridges 43. The heating cartridges 43 in the hot-pressing lower tool 41 and hot-pressing upper tool 42 are configured and arranged in such a way that the hot-pressing sides 41*a*, 42*a* can be heated to temperatures greater than 150° C., preferably between 180° C. and 250° C. The heating cartridges 43 can be controlled in such a way that the temperatures of the hot-pressing lower tool 41 and the hot-pressing upper tool 42 differ, wherein the hot-pressing upper tool 42 can have a higher temperature than the hot-pressing lower tool 41; the temperatures preferably differ by at least 25° C., preferably not more than 60° C., more preferably around 50° C. For this purpose, the heating cartridges 43 are arranged close to the contour of the formed part 10 in the respective hot-pressing upper tools 42 and hot-pressing lower tools 41, and the respective hot-pressing upper tools 42 and hot-pressing lower tools 41 are made of metal. Here, a heating cartridge 43 is arranged centrally in the inner tool 40*i* parallel to the closing direction SR with a first heating output, while in the outer tool six heating cartridges 43 with second heating outputs are arranged concentrically around the closing direction SR parallel to the hot-pressing side 41*a*, 42*a* of the inner tool 40*i*, wherein the first heating output is greater than the second heating output. Furthermore, here the hot-pressing upper tools 42 comprise a covering 44 made of a thermally insulating material on the sides facing away from the formed part 10.

Figure 10:
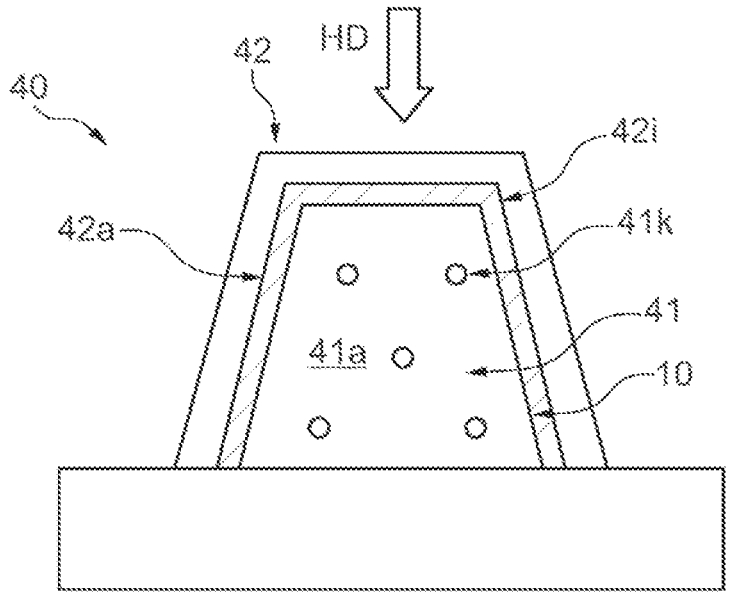
FIG. 10: shows a schematic representation of a further embodiment of the hot-pressing lower tool and hot-pressing upper tool of the hot-pressing station from FIG. 8 during hot-pressing.

FIG. 10 shows a schematic representation of a further embodiment of the hot-pressing lower tool 41 and hot-pressing upper tool 42 of the hot-pressing station 40 from FIG. 8 during hot-pressing. After prepressing has taken place, the prepressed formed part 10 is transferred to the hot-pressing station 40 by means of the suction tool 2, wherein the formed part 10 is removed from the suction tool 2 for subsequent hot-pressing. The hot-pressing station 40 comprises a hot-pressing lower tool 41 with a hot-pressing side 41*a* adapted to a contour of the formed part 10 and a hot-pressing upper tool 42, wherein the formed part 10 is placed from the suction tool 2 onto the hot-pressing lower tool 41 (here with a negative form. With a positive form, it would be inserted into the hot-pressing lower tool). During hot-pressing, the hot-pressing upper tool 42 is then pressed onto the hot-pressing lower tool 41 with the formed part 10 arranged in between. The hot-pressing lower tool 41 may be made of metal. The hot-pressing lower tool 41 also comprises channels 41*k* to its hot-pressing side 41*a*, with which the liquid solution can be at least partially removed from the formed part 10 during hot-pressing. These channels 41*k* can have a diameter of less than or equal to 1.0 mm, at least on the hot-pressing side. In this case, the channels can have any suitable geometry as a cross-sectional area. For example, the channels 41*k* have a round or elliptical cross section. The hot-pressing upper tool 42 is adapted to the contour of the formed part 10 at least with the side 42*i* facing the formed part; the hot-pressing upper tool 42 is preferably also made of metal. Different temperatures can be used for the hot-pressing lower tool 41 and the hot-pressing upper tool 42 during hot-pressing; preferably, the hot-pressing upper tool 42 has a higher temperature than the hot-pressing lower tool 41, the temperatures differing by at least 25° C., preferably not more than 60° C., particularly preferably by 50° C. The hot-pressing can be performed at a temperature greater than 150° C., preferably between 180° C. and 250° C. The hot-pressing 140 is performed at the hot-pressing pressure HD that is higher than the prepressing pressure VD. The hot-pressing pressure HD can be between 0.5 $N/mm^2$ and 1.5 $N/mm^2$, preferably between 0.8 $N/mm^2$ and 1.2 $N/mm^2$, wherein said pressure preferably is applied for a pressing time of less than 20 s, preferably for more than 8 s, more preferably between 10 and 14 s, even more preferably 12 s.

Figure 11:
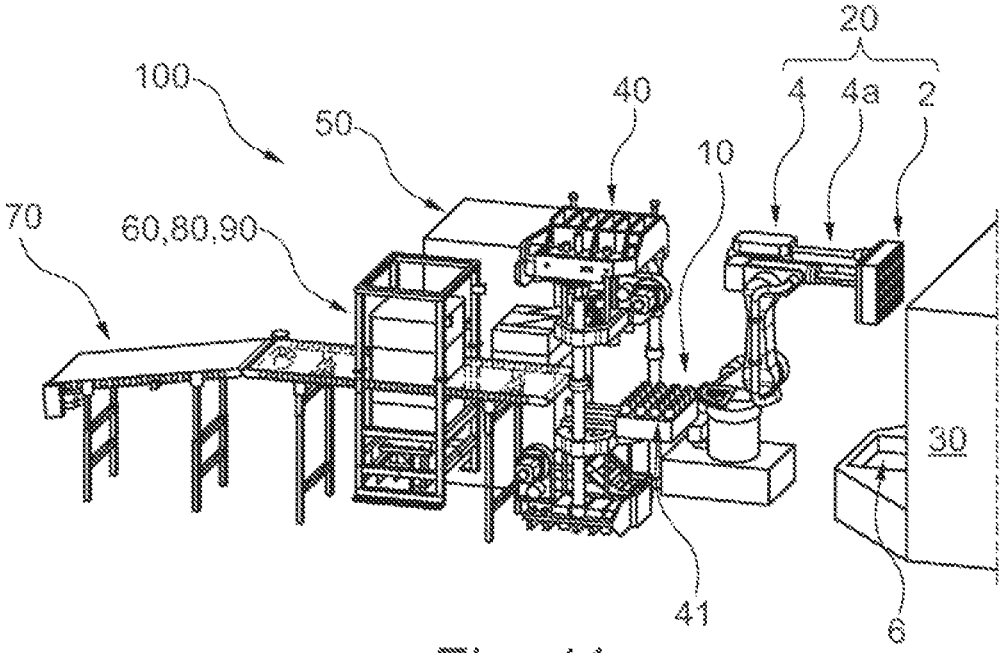
FIG. 11: shows an embodiment of the fiber-forming system according to some embodiments.

FIG. 11 shows an embodiment of the fiber-forming system 100 according to some embodiments for producing formed parts 10 from environmentally-friendly-degradable fiber material 11, comprising a reservoir 6 for providing a pulp 1 as a liquid solution with environmentally-friendly-degradable fiber material 11 as part of the preforming station 30. In a molding station 20, a movement unit 4 immerses a suction tool 2 attached to it, which has a suction head 21 with a three-dimensionally shaped suction head suction side 21*s*, the shape of which is adapted to a contour of the later formed part 10, into the pulp 1. The pulp is provided by a pulp processing and replenishment unit 35 and is continuously renewed and replenished during operation. The movement unit 4 is designed here as a robot with a robotic arm 4*a* that can move freely in space. A robot 4 can carry out precise and reproducible movements in a confined space and is therefore particularly suitable for guiding the suction tool 2 between the pulp reservoir 6 and the prepressing station 3 of the preforming station 30. The suction tool 2 is connected to the robotic arm 4*a* via an interface 4*s*. Such an interface 4*s* enables a quick change of the suction tool 2, if necessary. The suction tool 2 is configured to mold the formed part 10 by sucking the environmentally-friendly-degradable fiber material 11 onto the suction head suction side 21*s* by means of suction pressure SD (vacuum) in the suction tool 2. The prepressing station 3 is provided for prepressing the molded formed part 10 with a prepressing pressure VD to reduce a proportion of the liquid solution in the formed part 10 and to stabilize its shape. The hot-pressing station 40, shown here with the hot-pressing lower tool 41 extended to take over the preformed formed parts 10 from the suction tool 2, is provided with a hot-pressing pressure HD for hot-pressing 150 the prepressed formed part 10 and thus for the final shaping of the formed part 10 and for further reducing the proportion of the liquid solution provided in the formed part 10. The ejection unit 70 then ejects the final-shaped formed part 10. To control the process performed, the fiber-forming system 100 comprises a control unit 50 which is suitably connected to the other components 20, 30, 35, 40, 60, 70, 80, 90 of the fiber-forming system 100 in order to control these components, including a cutting unit 80 and/or a stacking unit 90 and/or a conveyor belt 95. In particular, the fiber-forming system 100 can additionally comprise a coating unit 60 for applying one or more functional coatings to the formed part 10.

Figure 12:
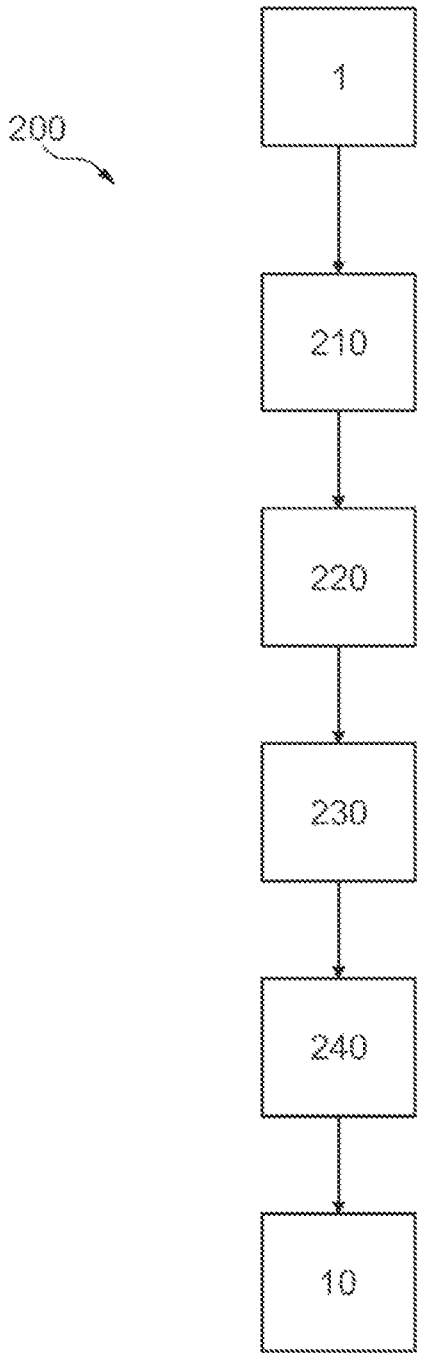
FIG. 12: shows a schematic representation of an embodiment of the method according to some embodiments.

FIG. 12 shows a schematic representation of an embodiment of the method 200 according to some embodiments for the production of formed parts 10 from environmentally-friendly-degradable fiber material 11 by means of a fiber-forming process in a fiber-forming system according to some embodiments comprising subsequent steps of molding 210 the formed part in a molding station 20 according to some embodiments from a reservoir 6 with a pulp 1 as a liquid solution with the environmentally-friendly-degradable fiber material 11; preforming 220 the formed part 10 in a preforming station 30 according to some embodiments; final shaping 230 the preformed part 10 in a hot-pressing station 40 according to some embodiments; and ejecting 240 the final-shaped formed part 10 from the fiber-forming system 100 according to some embodiments.

The following numbered clauses set out various non-limiting embodiments disclosed herein:

Set A

A1. A molding station (20) for a fiber-forming system (100) for molding (210) a formed part (10) made from environmentally-friendly-degradable fiber material (11) in a fiber-forming process comprising:

a suction tool (2) for sucking in the environmentally-friendly degradable fiber material (11) for molding (210) the formed part (10) from a reservoir (6) with a pulp (1) as a liquid solution with the environmentally-friendly degradable fiber material (11), wherein the suction tool (2) comprises a suction head (21) with a three-dimensionally shaped suction head suction side (21*s*), the shape of which is adapted to a contour of the later formed part (10), and the formed part (10) on the suction head suction side (21*s*) is formed by means of a vacuum in the suction tool (2); and a movement unit (4), on which the suction tool (2) is mounted, which is provided at least for placing or for partially immersing the suction tool (2) on or in the pulp (1).

A2. The molding station (20) according to any previous clause within set A, wherein the suction head suction side (21*s*) of the suction head (21) is formed by a porous screen (22) on a suction side surface (23*s*) of the suction head (21), wherein on the pulp side (22*p*) facing the pulp (1) of the screen (22), the environmentally-friendly-degradable fiber (11) adheres due to the suction.

A3. The molding station (20) according to any previous clause within set A, wherein the screen (22) has a wavy structure with wave crests (22*w*) and wave troughs (22*t*) along the suction-side surface (23*s*), wherein the screen (22) rests at least during suction with the wave crests (22*w*) of its side (22*s*) facing the suction-side surface (23*s*) on the suction-side surface (23*s*).

A4. The molding station (20) according to any previous clause within set A, wherein the suction tool (2) comprises a plurality of suction channels (23) which terminate on the suction-side surface (23 *s*) below the screen (22) and are distributed over the suction-side surface (23 *s*) in such a way that a substantially equal suction power is achieved in all areas between the screen (22) and the suction-side surface (23 *s*).

A5. The molding station (20) according to any previous clause within set A, wherein the suction channels (23) have openings in the suction-side surface (23*s*) with diameters of less than 4 mm.

A6. The molding station (20) according to any previous clause within set A, wherein the suction channels (23) have an uneven distribution on the suction-side surface (23 *s*), wherein in the area of negative edges in the formed part (10) 40%-60% fewer and/or in the area of positive edges 10%-30% more suction channels (23) are arranged per unit area than with plane surfaces.

A7. The molding station (20) according to any previous clause within set A, wherein the screen (22) is fastened in the suction head (21) only with reversible fastening means (28), possibly clamping means.

A8. The molding station (20) according to any previous clause within set A, wherein the screen (22) is fastened in at least some of the suction channels (23).

A9. The molding station (20) according to any previous clause within set A, wherein the suction head (21), on its end face (21*p*) facing the pulp (1), comprises a collecting ring (24) for receiving the liquid solution of the pulp (1) sucked through the suction head suction side (21*s*), which collecting ring is connected to a discharge channel (25) for the liquid solution.

A10. The molding station (20) according to any previous clause within set A, wherein the suction head suction side (21*s*) of the suction head (21) is designed either as a negative form, the suction head inside (21*i*), or as a positive form, the suction head outside (21*a*).

A11. The molding station (20) according to any previous clause within set A, wherein the suction tool (2) is a multi-tool with a plurality of suction heads (21).

A12. The molding station (20) according to any previous clause within set A, wherein the shapes of the suction heads (21) in the suction tool (2) can differ at least in part, possibly the same shapes of the suction heads (21) are arranged adjacent in the suction tool (2) in separate modules (29).

A13. The molding station (20) according to any previous clause within set A, wherein the suction tool (2) comprises a base plate (26) with suction heads (21) mounted thereon and a gas line system (27) in the base plate (26), which gas line system at least distributes the vacuum provided by a vacuum pump (5) to the suction heads (21) as the suction pressure (SD) for sucking in the fiber material (11); the gas line system (27) possibly also comprises compressed gas lines (27*d*) for applying compressed air on the suction heads (21).

A14. The molding station (20) according to any previous clause within set A, wherein the gas line system (27) for the suction pressure (SD) comprises main gas lines (27*h*) and secondary gas lines (27*n*), wherein the main gas lines (27*h*) are provided for generating a pre-vacuum and the secondary gas lines (27*n*) are provided as a supplement to the main gas lines (27*h*) for achieving the suction pressure (SD) after the suction tool (21) contacts the pulp (1).

A15. The molding station (20) according to any previous clause within set A, wherein one or more valves (27*v*) are suitably arranged in the gas line system (27) to switch off at least a suction pressure (SD) at the suction heads (21) as soon as the suction tool has left the pulp (1), and/or to at least switch on the secondary gas lines to the main lines as soon as the suction tool (2) is immersed in the pulp (1).

A16. The molding station (20) according to any previous clause within set A, wherein the movement unit (4) comprises a robotic arm (4*a*) which can move freely in space and on which the suction tool (2) is mounted.

A17. The molding station (20) according to any previous clause within set A, wherein the robotic arm (4*a*) is connected to the suction tool (2) with a suitable interface (4*s*) comprising all media supply connections for the suction tool (2).

A18. The molding station (20) according to any previous clause within set A, wherein the movement unit (4) is provided for completely immersing the suction head or heads (21) into the pulp (1) for contact (120).

A19. The molding station (20) according to any previous clause within set A, wherein the movement unit (4) is provided for transferring the formed parts (10) in the suction tool (2) to the prepressing station (3) of a preforming station (30) and/or to the hot-pressing station (40).

A20. The molding station (20) according to any previous clause within set A, wherein the movement unit (4) and the suction tool (2) are configured for leaving the formed parts (10) in the prepressing station (3) for prepressing in the suction tool (2) after the transfer to the preforming station (30).

A21. The molding station (20) according to any previous clause within set A, wherein the movement unit (4) and the suction tool (2) are configured for ejecting the formed parts (10) from the suction tool (2) in the hot-pressing station for the subsequent hot-pressing.

A22. The molding station (20) according to any previous clause within set A, wherein the movement unit (4) and the suction tool (2) are configured to eject the formed parts (10) from the suction heads (21) of the suction tool (2) by means of compressed air.

Set B

B1. A preforming station (30) for a fiber-forming system (100) for preforming (220) a formed part of environmentally-friendly-degradable fiber material (11) in a fiber-forming process comprising

- a reservoir (6) with a pulp (1) as a liquid solution with the environmentally-friendly-degradable fiber material (11) for molding the formed part (10), possibly arranged as a horizontal reservoir (6) that is open at the top; and
- a prepressing station (3) for preforming (220) the formed part (10) molded by means of a molding station (20) according to one of the preceding clauses by means of a suction tool (2) with a prepressing pressure (VD) to reduce a proportion of the liquid solution in the formed part (10) and to stabilize the shape of the formed part (10).

B2. The preforming station (30) according to any previous clause within set B, wherein the preforming station (30) further comprises a pulp preparation and replenishment unit (35) for replenishing the pulp (1) for the reservoir (6).

B3. The preforming station (30) according to any previous clause within set B, wherein the pulp preparation and replenishment unit (35) fills the reservoir (6) at least periodically, possibly continuously, as a function of the consumption of pulp by molding the formed part (10), in order to ensure a required fill level of the reservoir (6) for molding.

B4. The preforming station (30) according to any previous clause within set B, wherein the prepressing station (3) is arranged and configured in relation to the reservoir (6) in such a way that the liquid solution removed from the formed part by the prepressing is fed back into the reservoir (6).

B5. The preforming station (30) according to any previous clause within set B, wherein the prepressing station (3) is arranged in a vertical orientation above the reservoir (6), so that the liquid solution removed from the formed part by the prepressing flows back into the reservoir (6) from the prepressing station (3) directly into the reservoir (6).

B6. The preforming station (30) according to any previous clause within set B, wherein the prepressing station (3) comprises a prepressing lower tool (31), the shape of which is adapted to the formed part (10) remaining in the suction tool (2) in such a way that said formed part can be placed onto the prepressing lower tool in such a way that it is arranged between prepressing lower tool (31) and suction tool (2) so that the suction tool (2) can be pressed onto the prepressing lower tool (31) with the prepressing pressure (VD), or that the prepressing (140) is performed as membrane pressing, wherein the prepressing lower tool (31) is designed as a flexible membrane and the prepressing pressure (VD) is applied to the membrane as gas pressure, which then presses onto the outer contour (10*a*) of the formed part (10).

B7. The preforming station (30) according to any previous clause within set B, wherein the prepressing lower tool (31) has a pressing surface (31*a*) facing the formed part (10), which pressing surface has a lower surface roughness than the screen (22) of the suction tool (2).

B8. The preforming station (30) according to any previous clause within set B, wherein the prepressing lower tool (31) is made of metal or at least partially of an elastomer, possibly silicone.

B9. The preforming station (30) according to any previous clause within set B, wherein the prepressing lower tool (31) has a cavity (33) which is surrounded by a wall (34) made of the elastomer as a pressing surface (31*a*), wherein the prepressing station (3) is configured for applying a gas pressure (GD) to the cavity (33) during prepressing in order to generate or at least support the prepressing pressure (VD).

B10. The preforming station (30) according to any previous clause within set B, wherein the prepressing station (3) is designed as a multi-tool with a plurality of prepressing lower tools (31) adapted to the suction tool (2) as a multi-tool.

B11. The preforming station (30) according to any previous clause within set B, wherein the prepressing lower tools (31) are arranged on a common carrier plate (35), which is configured as an interface to the prepressing station (3) for reversible attachment to the prepressing station and/or for supplying the individual prepressing lower tools (31) with gas pressure.

B12. The preforming station (30) according to any previous clause within set B, wherein the carrier plate (35) additionally comprises a heating element (36), possibly a heating element (36) extending over the surface of the carrier plate (35), for heating the prepressing lower tools.

B13. The preforming station (30) according to any previous clause within set B, wherein the molding station (20) is part of the preforming station (30).

B14. The preforming station (30) according to any previous clause within set B, wherein the molding station (20) is connected to the pre-molding station (30) via suitable lines in such a way that the liquid solution and/or fiber material (11) that has passed through the suction head (21) is reintroduced into the pulp (1) via the pre-molding station (30).

Set C

C1. A hot-pressing station (40) for a fiber-forming system (100) for final shaping (230) a formed part made of environmentally-friendly-degradable fiber material (11) in a fiber-forming process, comprising a hot-pressing lower tool (41) adapted to a contour (10*i*) of the formed part (10) for receiving of the formed part (10) and a hot-pressing upper tool (42), correspondingly adapted to the formed part (10), for placing onto or inserting into the formed part (10) along a closing direction (SR) of the hot-pressing station (40), wherein the hot-pressing lower tool (41) and/or the hot-pressing upper tool (42) are provided for exerting a hot-pressing pressure (HD) on the formed part (10) arranged between the hot-pressing lower tool (41) and the hot-pressing upper tool (42) during hot-pressing.

C2. The hot-pressing station (40) according to any previous clause within set C, wherein in the case of a negative form of a suction tool (2), the hot-pressing lower tool (41) also has a negative form and is provided as an inner tool (40*i*), while the hot-pressing upper tool (42) is placed on said inner tool as an outer tool (40*a*) for hot-pressing, and in the case of a positive form of the suction tool (2), the hot-pressing lower tool (41) also has a positive form and is provided as an outer tool (40*a*), while the hot-pressing upper tool (42) is inserted into the hot-pressing lower tool (41) as an inner tool (40*i*) for hot-pressing.

C3. The hot-pressing station (40) according to any previous clause within set C, wherein respective hot-pressing sides (41*a*, 42*a*) of the hot-pressing lower tool (41) and of the hot-pressing upper tool (42) facing the formed part (10) are heated by means of electric heating cartridges (43).

C4. The hot-pressing station (40) according to any previous clause within set C, wherein the heating cartridges (43) in the hot-pressing lower tool (41) and hot-pressing upper tool (42) are configured and arranged in such a way that the hot-pressing sides (41*a*, 42*a*) are heated to temperatures greater than 150° C., possibly between 180° C. and 250° C.

C5. The hot-pressing station (40) according to any previous clause within set C, wherein the heating cartridges (43) are controlled in such a way that the temperatures of the hot-pressing lower tool (41) and the hot-pressing upper tool (42) differ.

C6. The hot-pressing station (40) according to any previous clause within set C, wherein the hot-pressing upper tool (42) has a higher temperature than the hot-pressing lower tool (41), possibly the temperatures differ by at least 25° C., possibly not more than 60° C., particularly possibly by 50° C.

C7. The hot-pressing station (40) according to any previous clause within set C, wherein the heating cartridges (43) are arranged close to the contour of the formed part (10) in the respective hot-pressing upper tools (42) and hot-pressing lower tools (41), possibly the respective hot-pressing upper tools (42) and hot-pressing lower tools (41) made of metal.

C8. The hot-pressing station (40) according to any previous clause within set C, wherein that at least one heating cartridge (43) with a first heating output is arranged in the inner tool (40*i*), while a plurality of heating cartridges (43) with second heating outputs is arranged in the outer tool around the hot-pressing side (41*a*, 42*a*) of the outer tool (40*a*); possibly the first heating output is greater than the second heating output.

C9. The hot-pressing station (40) according to any previous clause within set C, wherein in the case of a single heating cartridge (43) in the inner tool (40*i*), said heating cartridge is arranged centrally in the inner tool (40*i*) parallel to the closing direction (SR), and/or in the case of several heating cartridges (43) in the inner tool (40*i*), said heating cartridges are arranged concentrically around the closing direction (SR) parallel to the hot-pressing side (41*a*, 42*a*) of the inner tool (40*i*).

C10. The hot-pressing station (40) according to any previous clause within set C, wherein in the outer tool (40*a*) a plurality of heating cartridges (43) is arranged concentrically around the closing direction (SR) parallel to the hot-pressing side (41*a*, 42*a*) of the outer tool (40*a*).

C11. The hot-pressing station (40) according to any previous clause within set C, wherein the hot-pressing lower tools (41) and/or the hot-pressing upper tools (42) comprise a covering (44) made of a thermally insulating material on the sides facing away from the formed part (10).

C12. The hot-pressing station (40) according to any previous clause within set C, wherein the hot-pressing lower tool (41) comprises a plurality of channels (41*k*) to its hot-pressing side (41*a*), with which the liquid solution can be at least partially discharged from the formed part (10) during hot-pressing.

C13. The hot-pressing station (40) according to any previous clause within set C, wherein the channels (41*k*) have a diameter of less than or equal to 1.0 mm, at least on the hot-pressing side (41*a*).

C14. The hot-pressing station (40) according to any previous clause within set C, wherein both the hot-pressing lower tool (41) and the hot-pressing upper tool (42) as a multi-tool with a plurality of hot-pressing lower tools (41) and hot-pressing upper tools (42) are arranged on respective carrier plates (45) for the respective hot-pressing lower tools (41) and hot-pressing upper tools (42).

C15. The hot-pressing station (40) according to any previous clause within set C, wherein the carrier plates (45) in the hot-pressing station (40) are laterally movably mounted to enable the respective hot-pressing lower tools (41) and hot-pressing upper tools (42) to be changed as multi-tools outside of a process space of the hot-pressing station (40).

C16. The hot-pressing station (40) according to any previous clause within set C, wherein the carrier plate (45) of the hot-pressing upper tools (42) of the multi-tool is provided with gas lines in order to, depending on the process step, apply a vacuum in the respective hot-pressing upper tools (42) for holding the formed parts (10) in and/or an overpressure for ejecting the final-shaped formed parts (10) from the hot-pressing upper tools (42).

C17. The hot-pressing station (40) according to any previous clause within set C, wherein expansion means (47) are arranged between the carrier plate (45) and a holder (46) for the carrier plate.

C18. The hot-pressing station (40) according to any previous clause within set C, wherein thermally insulating material (44) is arranged between the carrier plate (45) and the holder (46).

Set D

D1. A fiber-forming system (100) comprising at least one molding station (20) according to any previous clause within set A, a preforming station (30) according to any previous clause within set B, and a hot-pressing station (40) according to any previous clause within set C for producing a formed part (10) from environmentally-friendly-degradable fiber material (11) by means of a fiber-forming process performed in the fiber-forming system (100).

D2. The fiber-forming system (100) according to any previous clause within set D, wherein the fiber-forming system (100) comprises a control unit (50) for controlling at least the molding station (20), the preforming station (30) and the hot-pressing station (40) and their sub-components (2, 3, 4, 5, 6).

D3. The fiber-forming system (100) according to any previous clause within set D, wherein the fiber-forming system (20) additionally comprises a coating unit (60) for applying one or more functional coatings to the formed part (10).

D4. The fiber-forming system (100) according to any previous clause within set D, wherein the fiber-forming system (100) further comprises an ejection unit (70) for ejecting the final-shaped formed part (10), possibly the forming system also comprises at least a cutting unit (80) and/or a stacking unit (90) and/or a conveyor belt (95) for the formed parts (10).

D5. A method (200) for producing formed parts (10) from environmentally-friendly-degradable fiber material (11) by means of a fiber-forming process in a fiber-forming system (100) according to any previous clause within set D, comprising the following steps:

- molding (210) the formed part in a molding station (20) according to any previous clause within set A from a reservoir (6) with a pulp (1) as a liquid solution with the environmentally-friendly degradable fiber material (11);
- preforming (220) the molded formed part (10) in a preforming station (30) according to any previous clause within set B;
- final shaping (230) of the preformed formed part (10) in a hot-pressing station (40) according to any previous clause within set C; and
- ejecting (240) the final-shaped formed part (10) from the fiber-forming system (100).

At this point it should be explicitly pointed out that features of the solutions described above or in the claims and/or figures can also be combined if necessary in order to be able to implement or achieve the features, effects and advantages explained in a cumulative manner.

It goes without saying that the exemplary embodiment explained above is merely a first embodiment of the present disclosure. In this respect, the design of disclosed embodiments is not limited to this exemplary embodiment.

What is claimed is:

1. An apparatus for preforming a formed part, comprising:

a horizontal reservoir having an open top, the horizontal reservoir containing a pulp, wherein the pulp is a liquid solution comprising an environmentally-friendly-degradable fiber material for molding the formed part by utilizing a suction tool included in a molding station of the apparatus; and a prepressing station configured to preform the formed part by applying a prepressing pressure to reduce a proportion of the liquid solution in the formed part and to stabilize a shape of the formed part, wherein the prepressing station includes a stationary prepressing lower tool, the prepressing tool comprising multiple pressing surfaces extending from a carrier plate of the prepressing lower tool in at least one direction, the pressing surfaces being adapted to the suction tool that molds the formed part, wherein the suction tool is pressed onto the stationary prepressing lower tool, and wherein the prepressing station is arranged separately from a downstream hot-pressing station.

2. The apparatus of claim 1, further comprising a pulp preparation and replenishment unit configured to replenish the pulp in the horizontal reservoir.

3. The apparatus of claim 2, wherein the pulp preparation and replenishment unit fills the horizontal reservoir at least periodically as a function of consumption of pulp by molding the formed part.

4. The apparatus of claim 1, wherein the prepressing station is arranged and configured in relation to the horizontal reservoir such that the liquid solution removed from the formed part by the prepressing station is fed back into the horizontal reservoir.

5. The apparatus of claim 4, wherein the prepressing station is arranged in a vertical orientation above the horizontal reservoir such that the liquid solution removed from the formed part by the prepressing station flows back into the reservoir from the prepressing station directly into the horizontal reservoir.

6. The apparatus of claim 1, wherein the prepressing lower tool has a shape adapted to the formed part remaining in the suction tool, and wherein the shape of the prepressing lower tool allows said formed part to be placed onto the prepressing lower tool in an arrangement between the prepressing lower tool and the suction tool where the suction tool can be pressed onto the prepressing lower tool with the prepressing pressure.

7. The apparatus of claim 1, wherein the prepressing station is configured to perform prepressing as membrane pressing, and wherein the prepressing lower tool is a flexible membrane and the prepressing pressure is applied to the membrane as gas pressure that presses onto an outer contour of the formed part.

8. The apparatus of claim 1, wherein the pressing surfaces face the formed part, and wherein at least one of the pressing surfaces has a lower surface roughness than a screen of the suction tool.

9. The apparatus of claim 1, wherein the prepressing lower tool is made at least partially of an elastomer.

10. The apparatus of claim 9, wherein the prepressing lower tool has a cavity that is surrounded by a wall made of the elastomer as at least one of the pressing surfaces, wherein the prepressing station is configured to apply a gas pressure to the cavity during prepressing in order to at least support the prepressing pressure.

11. The apparatus of claim 1, wherein, the carrier plate is configured as an interface to the prepressing station for reversible attachment to the prepressing station and/or for supplying individual pressing surfaces with gas pressure.

12. The apparatus of claim 1, wherein the carrier plate includes a heating element that extends over a surface of the carrier plate for heating the pressing surfaces.

13. The apparatus of claim 1, wherein the molding station is connected to a pre-molding station via suitable lines such that a liquid solution and/or fiber material that has passed through a suction head of the suction tool is reintroduced into the pulp via the pre-molding station.

14. The apparatus of claim 1, wherein the suction tool configured to suck in the pulp from the horizontal reservoir and form the formed part during application of a vacuum in the suction tool.

15. The apparatus of claim 1, further comprising the hot-pressing station downstream of the prepressing station, wherein the hot-pressing station is configured to exert a hot-pressing pressure on the preformed part when the preformed part is positioned between a lower tool and an upper tool of the hot-pressing station.

16. The apparatus of claim 15, wherein the hot-pressing station includes:

a hot-pressing lower tool adapted to a contour of the formed part for receiving the formed part; and a hot-pressing upper tool, correspondingly adapted to the formed part, for placing onto or inserting into the formed part along a closing direction of the hot-pressing station, wherein the hot-pressing lower tool and/or the hot-pressing upper tool are provided for exerting the hot-pressing pressure on the formed part when the preformed part is positioned between a lower tool and an upper tool of the hot-pressing station, wherein both the hot-pressing lower tool and the hot-pressing upper tool are multi-tools in a plurality of hot-pressing lower tools and hot-pressing upper tools arranged on respective carrier plates for the respective hot-pressing lower tools and hot-pressing upper tools.

17. A method for forming a formed part, comprising:

receiving, at a prepressing station, a formed part positioned in a suction tool of a molding station, wherein the formed part is formed from a pulp located in a horizontal reservoir with an open top, the pulp being a liquid solution comprising an environmentally-friendly-degradable fiber material for molding the formed part; and preforming the formed part by applying a prepressing pressure to the formed part with the formed part positioned in the suction tool, the prepressing pressure reducing a proportion of the liquid solution in the formed part and stabilizing a shape of the formed part, wherein the prepressing station includes a stationary prepressing lower tool, the prepressing lower tool comprising multiple pressing surfaces extending from a carrier plate of the prepressing lower tool in at least one direction, the pressing surfaces being adapted to the suction tool, wherein the suction tool is pressed onto the stationary prepressing lower tool, and wherein the prepressing station is arranged separately from a downstream hot-pressing station.

18. The method of claim 17, further comprising filling the reservoir at least periodically as a function of consumption of the pulp by forming the formed part, wherein the filling maintains a predetermined fill level of the reservoir for forming the formed part.

19. The method of claim 17, further comprising providing liquid solution removed from the formed part during application of the prepressing pressure back into the reservoir.

20. The method of claim 17, further comprising hot-pressing the formed part after preforming, wherein the hot-pressing includes:

moving the preformed part to a hot-pressing station; and exerting a hot-pressing pressure on the preformed part when the preformed part is positioned between a lower tool and an upper tool of the hot-pressing station, wherein a shape of the lower tool is adapted to a contour of the preformed part, the shape of the lower tool allowing the lower tool to receive the preformed part, and wherein a shape of the upper tool is adapted to the contour of the preformed part, the shape of the upper tool allowing the upper tool to be placed onto or inserted into the preformed part along a closing direction of the hot-pressing station.

* * * * *